US008253511B2

(12) United States Patent
Oota et al.

(10) Patent No.: US 8,253,511 B2
(45) Date of Patent: Aug. 28, 2012

(54) TRIPLE PLATE FEEDER—WAVEGUIDE CONVERTER HAVING A SQUARE RESONANCE PATCH PATTERN

(75) Inventors: Masahiko Oota, Oyama (JP); Hisayoshi Mizugaki, Chikusei (JP); Keisuke Iijima, Chikusei (JP); Takashi Saitou, Chikusei (JP); Masaya Kirihara, Chikusei (JP)

(73) Assignee: Hitachi Chemical Co., Ltd., Tokyo (JP)

( * ) Notice: Subject to any disclaimer, the term of this patent is extended or adjusted under 35 U.S.C. 154(b) by 362 days.

(21) Appl. No.: 12/169,953

(22) Filed: Jul. 9, 2008

(65) Prior Publication Data

US 2008/0303721 A1 Dec. 11, 2008

Related U.S. Application Data

(62) Division of application No. 11/575,099, filed as application No. PCT/JP2005/019584 on Oct. 25, 2005, now Pat. No. 7,411,553.

(30) Foreign Application Priority Data

Mar. 16, 2005 (JP) ..... P2005-074915
Mar. 16, 2005 (JP) ..... P2005-074917
Mar. 16, 2005 (JP) ..... P2005-074918

(51) Int. Cl.
*H01P 5/107* (2006.01)

(52) U.S. Cl. ..... 333/26
(58) Field of Classification Search ..... 333/26
See application file for complete search history.

(56) References Cited

U.S. PATENT DOCUMENTS 2,877,429 A * 3/1959 Sommers et al. ..... 333/24 R
(Continued)

FOREIGN PATENT DOCUMENTS

EP 0783189 7/1997
(Continued)

OTHER PUBLICATIONS

European Official Action issued on Mar. 12, 2010, for Application No. 05 799 388.3-1248.

(Continued)

*Primary Examiner* — Benny Lee
(74) *Attorney, Agent, or Firm* — Antonelli, Terry, Stout & Kraus, LLP.

(57) ABSTRACT

A planar antenna module according to one preferred embodiment of the present invention comprises an antenna portion (101), a feeder portion (102), and a connection plate (18). The antenna portion (101) includes a first ground plate (11) having a first slot (21), a second ground plate (12) having dielectrics, an antenna substrate having a radiation element (41), a third ground plate (13) having dielectrics, a fourth ground plate (14). The feeder portion (102) includes the fourth ground plate (14), a fifth ground plate (15), a feed substrate (50), a sixth ground plate (16), a seventh ground plate (17). The connection plate (18) has a second waveguide opening portion (64). The connection plate (18) to be connected with a high frequency circuit, the seventh ground plate (17), the sixth ground plate (16), the feed substrate (50), the fifth ground plate (15), the fourth ground plate (14), the third ground plate (13) including the third dielectric (33) and the fourth dielectric (34), the antenna substrate (40), the second ground plate (12) including the first dielectric (31) and the second dielectric (32), and the first ground plate (11) are stacked in this order.

3 Claims, 24 Drawing Sheets

(b)

U.S. PATENT DOCUMENTS

| | | | | |
|---|---|---|---|---|
| 4,562,416 | A * | 12/1985 | Sedivec | 333/26 |
| 5,414,394 | A * | 5/1995 | Gamand et al. | 333/26 |
| 6,545,572 | B1 | 4/2003 | Ohta et al. | |
| 6,720,931 | B1 | 4/2004 | Michisaka et al. | |
| 7,026,993 | B2 | 4/2006 | Zhang et al. | |
| 7,307,586 | B2 | 12/2007 | Peshlov et al. | |
| 2005/0030245 | A1 | 2/2005 | Croswell et al. | |

FOREIGN PATENT DOCUMENTS

| | | |
|---|---|---|
| EP | 1 291 966 | 3/2003 |
| JP | 60-223204 | 11/1985 |
| JP | 62-023209 | 1/1987 |
| JP | 02-104006 | 4/1990 |
| JP | 03-226690 | 10/1991 |
| JP | 04-082405 | 3/1992 |
| JP | 04-369104 | 12/1992 |
| JP | 06-070305 | 3/1994 |
| JP | 10-190351 | 7/1998 |
| JP | 11-261308 | 9/1999 |
| JP | 2002-163762 | 6/2002 |
| JP | 2002-299949 | 10/2002 |
| JP | 2003-258548 | 9/2003 |
| JP | 2003-309426 | 10/2003 |
| JP | 2004-215050 | 7/2004 |
| JP | 2004-363811 | 12/2004 |
| WO | WO 98/26642 | 6/1998 |

OTHER PUBLICATIONS

Korean Official Action issued Mar. 12, 2008, for Application No. 10-2007-7000182.

Extended European Search Report, including European Search Report and European Search Opinion, dated May 11, 2010, for Application No. 10153155.6-1248/2192654.

Extended European Search Report, including European Search Report and European Search Opinion, dated May 11, 2010, for Application No. 10153154.9-1248/2190066.

"Concise explanation" of JP 6-70305 dated Sep. 30, 1994.

C. Craeye, et al., "Effects of array truncation on the depth of deterministic nulls obtained with a broadband phased array", IEEE Antennas and Propagation Society International Symposium, vol. 4, No. 16, Jun. 16, 2002, pp. 232-235 (XP010592411).

S. Lundgren, "A study of mutual coupling effects on the direction finding performance of ESPRIT with a linear microstrip patch array using the Method of Moments", IEEE Antennas and Propagation Society International Symposium, 1996 Digest, Jul. 21, 1996, pp. 1372-1375 (XP002580041).

Chinese Official Action issued Jun. 9, 2010, for Application No. 2005800217954.0.

Japanese Official Action issued Aug. 10, 2010, for Application No. 2007-508016.

Extended European Search Report dated Jun. 22, 2009, including Supplementary European Search Report and European Search Opinion for Application No. EP 05 79 9388.

Japanese Official Action issued Sep. 8, 2009, for Application No. 2007-508016.

Office Action issued on Mar. 14, 2011, in the counterpart European Application No. 05 799 388.3.

Official Action issued on Feb. 6, 2012, in the counterpart Chinese Application No. 201010621688.7.

* cited by examiner (a)
PRIOR ART (b)
PRIOR ART (a)
PRIOR ART (b)
PRIOR ART (c)
PRIOR ART (d)
PRIOR ART (a)

(a)
PRIOR ART (b)
PRIOR ART (c)
PRIOR ART (a)

TRIPLE PLATE FEEDER—WAVEGUIDE CONVERTER HAVING A SQUARE RESONANCE PATCH PATTERN

This application is a Divisional application of prior application Ser. No. 11/575,099, submitted Mar. 12, 2007, which is a National Stage Application filed under 35 U.S.C. §371 of International (PCT) Application No. PCT/JP2005/019584, filed Oct. 25, 2005. application Ser. No. 11/575,099 has issued as U.S. Pat. No. 7,411,553, issued Aug. 12, 2008. The contents of application Ser. No. 11/575,099 are incorporated herein by reference in their entirety.

TECHNICAL FIELD

The present invention relates to a planar array antenna for use in communications in a millimeter wave band, an antenna module using the same, and a triple plate feeder-waveguide converter.

BACKGROUND ART

In a planar antenna module that has a plurality of antennas formed on the same plane and carries out transmission and reception in a millimeter wave band, a third waveguide opening (65) formed in a fourth ground plate (14) and a fourth waveguide opening (66) formed in a ninth ground plate (19) are connected by a waveguide slot portion (8) formed in the ninth ground plate (19), as illustrated in FIG. 1. Such a planar antenna is disclosed for example in Japanese Patent Application Laid-open Publication No. 2002-299949.

In the planar antenna module using a prior art port-connection method illustrated in FIG. 1, when the fourth ground plate (14) and the ninth ground plate (19) illustrated in FIGS. 2(*a*) to 2(*d*) are not firmly attached on a separation portion for a waveguide slot portion (8) adjacent thereto, there will be an increased loss in a waveguide portion formed by the waveguide slot portion (8) of the ninth ground plate (19) and the fourth ground plate (14), and an electricity leak to adjacent waveguide portions. For example, when the desired frequency is in an extremely high frequency band such as a 76.5 GHz band, even if the separation portion of the waveguide slot portion (8) contacts the fourth ground plate (14) as closely-attached as possible by improving flatness of the contact surfaces, or the surface roughness of the waveguide slot portion (8) is improved as much as possible by producing the fourth ground plate (14) and the ninth ground plate (19) from a cutting work product, a loss of about 0.3 dB per unit length of 1 cm is inevitable. Since a waveguide that connects an input/output port of the antennas, that is, a third waveguide opening (65) formed in the fourth ground plate (14), and an input/output port of a millimeter wave circuit, that is, a fourth waveguide opening (66) formed in the ninth ground plate (19), needs to be up to 5 cm long, the insertion loss taking place over the length from the input/output port of the antennas to the input/output port of the millimeter wave circuit amounts to about 1.8 dB as a whole as illustrated in FIG. 3. In addition, when the fourth ground plate (14) and the ninth ground plate (19) are made by casting or the like with the aim of reduced costs, they can be warped and undulated. As a result, a contact accuracy between the separation portion of the waveguide slot (8) and the fourth ground plate (14) is not retained and the surface protection treatment or the like is required in order to prevent corrosion. Therefore, there exists a disadvantage in that the insertion loss becomes larger when using a casting method than when using a cutting work product to make the ground plates (14) (19) and thus cost reduction becomes difficult.

In a planar array antenna for use in an in-vehicle radar or high speed communications in a millimeter wave band, it is important to realize a high gain and wide band characteristic. The inventors of the present invention have configured an antenna illustrated in FIG. 11 as a high-gain planar antenna applicable to such a usage in order to examine a reduction in feeder loss and undesired feeder radiation (See Japanese Patent Application Laid-open Publication No. H04-082405).

In such an antenna, a traverse component of energy propagating in a traverse direction is generated between the ground plate and the slot plate, except for an energy component radiated directly outward from the slot, when the patch is excited via the feeder. It has been known that the traverse component is then radiated out from the adjacent slot, thereby placing an adverse effect on an array-antenna gain, the effect being caused due to a phase relation with the component radiated directly outward from the slot. Namely, the maximum in the array-antenna gain appears at a particular arrangement distance as illustrated in FIG. 13, thereby realizing a high gain and highly efficient antenna.

In addition, in such usages, in order to detect a direction of a vehicle ahead or automatically choose a direction that yields a high sensitivity, a transmitting antenna and a plurality of receiving antennas are integrally constructed as illustrated in FIG. 14 and a signal received by each antenna can be subjected to a phase control and a selective synthesis, thereby enabling a beam direction control and a selective extraction of the signal coming from a particular direction.

In this case, since detection accuracy for a particular direction and a detection range can be improved by making uniform a gain and directivity of a plurality of the receiving antennas, it is important to realize uniform characteristics over the receiving antennas.

As described above, in case of the triple plate planar antenna constructed integrally with the transmitting antenna and the plurality of the receiving antennas, it is difficult to make uniform the antenna gain and directivity, since a component of energy propagating in a traverse direction is different in a center portion of the antenna array from in a peripheral portion of the antenna array. Although it is considered to provide a parasite element electromagnetically-coupled to a radiation element as illustrated in FIG. 12 to reduce a component of energy propagating in a traverse direction, it is difficult to address it due to an increase of the number of elements etc.

By the way, in recent years, an adoption of the system in which a feeder is configured into a triple plate type has become a main stream in a planar antenna in a microwave and millimeter wave band (See Japanese Utility Model Application Laid-open Publication No. H06-070305, and Japanese Patent Application Laid-open Publication No. 2004-215050, for example). In the planar antenna adopting the triple plate feeder system, electrical power to be fed with each antenna element is synthesized by the triple plate feeder. In a connection portion of the synthesized electricity between a final output portion and an RF signal process circuit, a triple plate feeder-waveguide converter is used frequently, because it is easily assembled and has a high reliability. A structure of the conventional triple plate feeder-waveguide converter is illustrated in FIGS. 23(*a*) to 23(*c*). In this structure, in order to facilitate a conversion to the waveguide with low loss, a film substrate 140 on which a strip feeder conductor 130 is formed is arranged over the surface of the ground plate 111 via a dielectric 120*a* {FIGS. 23(*b*) and 23(*c*)} and an upper ground plate 150 is arranged thereabove via dielectric 120*b* {FIGS. 23(*b*) and 23(*c*)} so as to configure the triple plate feeder. In the following, reference is made to FIGS. 23(*a*)-23(*c*). In addition, when connecting a waveguide input portion 160 (see FIGS. 23(*b*) and 23(*c*)) of the circuit system, a through hole having the same inner dimension as that of the waveguide is provided in the ground plate 111; a metal spacer portion 170*a* {FIGS. 23(*b*) and 23(*c*)} having the same thickness as the dielectric 120*a* is provided in order to support the film substrate 140; the film substrate 140 is sandwiched by the metal spacer portion 170*a* and a metal spacer portion 170*b* {FIGS. 23(*b*) and 23(*c*)} having the same dimension; an upper ground plate 150 having a through hole with the same inner dimension as the waveguide is arranged on top of the metal spacer portion 170*b* in such a way that the through hole formed in the ground plate 111, a waveguide portion formed by the inner wall of the metal spacers 170*a*, 170*b*, and the through hole formed in the upper ground plate 150 coincide with one another; and a short-circuit metal plate 180 is arranged so as to close the through hole formed in the ground plate 5. An insertion length A of the strip feeder conductor 130 that is inserted into the waveguide illustrated in FIG. 23(*a*) and a short-circuit distance L illustrated in FIG. 23(*b*) are set as desired, thereby realizing the triple plate feeder-waveguide converter having a low loss in a wider frequency band intended to be utilized.

In the conventional triple plate feeder-waveguide converter illustrated in FIGS. 23(*a*) to 23(*c*), since a wavelength of electromagnetic wave in a millimeter wave band, for example, an electromagnetic wave having a frequency of about 76 GHz, is short, only a slight degradation in mechanical accuracy of the insertion length A of the strip feeder conductor (130 (FIGS. 23(*a*) and 23(*b*)) and the short-circuit length L (FIG. 23(*b*) can lead to a deterioration in reflection characteristics. Therefore, a machining method realizing a high mechanical accuracy or an adoption of a structure yielding a high precision is prerequisite. Additionally, in order to adjust the short-circuit length L, a short-circuit length adjustment metal plate 190 (FIGS. 23(*c*) and 24(*d*)) having a through hole with an inner dimension that is the same as that of the waveguide may be required, as shown in FIG. 23(*c*). Therefore, there exits a disadvantage in that a production cost is raised by an increased number of parts.

The objective of the present invention is an inexpensive provision of a planar antenna module that is able to realize a reduction in loss, a reduction in characteristic variation caused by an assembling error, and an improved stability in frequency characteristics.

Another objective of the present invention is a provision of a triple plate planar array antenna that is able to realize a uniform antenna characteristic between antennas in the center portion and those in the peripheral portion of the antenna array configured by arranging a plurality of compact-sized antennas therein.

Yet another objective of the present invention is an inexpensive provision of an easy-to-assemble triple plate feeder-waveguide converter that is able to make unnecessary the short-circuit metal plate 180 and the short-circuit length adjustment metal plate 190, both of which have been required in a conventional structure, without impairing a low loss characteristic that has been conventionally realized, and that has a high connection reliability.

SUMMARY OF THE INVENTION

A first aspect of the present invention provides a planar antenna comprising a connection plate (18) to be connected with a high frequency circuit, a feeder portion (102), and an antenna portion (101) that are stacked in this order. The antenna portion (101) includes an antenna substrate (40) on which a plurality of antennas composed of a set of a first feeder (42) connected to a radiation element (41) and a first connection portion (43) electromagnetically coupled with the feeder portion (102); a first ground plate (11) having a first slot (21) in a position corresponding to the position of the radiation element (41); a second ground plate (12) that is provided between the antenna substrate (40) and the first ground plate (11) and has a first dielectric (31), a second dielectric (32), and a first connection port formation portion (22) in a position corresponding to the position of the first connection portion (43); a fourth ground plate (14) having a second slot (24) in a position corresponding to the position of the first connection portion (43); a third ground plate (13) that is provided between the antenna substrate (40) and the fourth ground plate (14) and has a third dielectric (33), a fourth dielectric (34), and a second connection port formation portion (23) in a position corresponding to the portion of the first connection portion (43).

The feeder portion (102) includes a seventh ground plate (17) having a first waveguide opening portion (63) in a position corresponding to the position of the third connection portion (53); a feed substrate (50) in which a plurality of feeders are formed, the feeders being composed of a set of a second feeder (51), a second connection portion (52) electromagnetically coupled with the first connection portion (43), and a third connection portion (53) electromagnetically coupled with the first waveguide opening portion (63) of the seventh ground plate (17); a fifth ground plate (15) that is provided between the feed substrate (50) and the fourth ground plate (14) and has a third connection port formation portion (25) in a position corresponding to the position of the second connection portion (52), a first waveguide opening formation portion (61) in a position corresponding to the position of the first waveguide opening portion (63), and an air gap portion (71) for allowing the connection port formation portion (25) to be in communication with the first waveguide opening formation portion (61); and a sixth ground plate (16) that is provided between the feed substrate (50) and the seventh ground plate (17) and has a fourth connection port formation portion (26) in a position corresponding to the position of the second connection portion (52), a second waveguide opening formation portion (62) in a position corresponding to the position of the first waveguide opening portion (63) and an air gap portion (72) for allowing the fourth connection port formation portion (26) to be in communication with the second waveguide opening formation portion (62).

The connection plate (18) has a second waveguide opening portion (64) in a position corresponding to the position of the first waveguide opening portion (63) of the seventh ground plate (17) of the feeder portion (102).

The connection plate (18) to be connected with a high frequency circuit, the seventh ground plate (17), the sixth ground plate (16), the feed substrate (50), the fifth ground plate (15), the fourth ground plate (14), the third ground plate (13) including the third dielectric (33) and the fourth dielectric (34), the antenna substrate (40), the second ground plate (12) including the first dielectric (31) and the second dielectric (32), and the first ground plate (11) are stacked in this order.

According to one embodiment of the present invention, there is provided an inexpensive planar antenna module that is able to realize a reduction in loss, a reduction in characteristic variation caused by an assembling error, and an improved stability in frequency characteristics.

In the prior triple plate planar antenna, when the traverse component of the propagating wave is efficiently utilized and its effect is placed evenly on every receiving antenna elements, the antenna characteristic should have made uniform.

A second aspect of the present invention provides a triple plate planar array antenna comprising an antenna circuit substrate (3) having thereon a radiation element (5) and a feeder (6), the substrate (3) being disposed over the surface of a ground plate (1) via a dielectric (2*a*) and a metal spacer (9*a*) therebetween, a slot plate (4) having a slot opening (7) to be disposed above the radiation element (5) so as to radiate electromagnetic wave, the plate (4) being disposed over the surface of the antenna circuit substrate (3) via a dielectric (2*b*) and a metal spacer (9*b*) therebetween. The dummy slot opening (8) is provided adjacent to said slot opening (7).

A third aspect of the present invention provides a triple-plate planar array antenna according to the second aspect, wherein a plurality of said slot openings (7) are arranged at intervals of from 0.85 to 0.93 times a free space wavelength $\lambda_0$ at a center wavelength of a wavelength band to be used, and wherein a plurality of said dummy slot openings (8) are arranged at intervals of from 0.85 to 0.93 times a free space wavelength $\lambda_0$ at a center wavelength of a wavelength band to be used.

A fourth aspect of the present invention provides a triple-plate planar array antenna according to the second or the third aspect, wherein a plurality of said dummy slot openings (8) are arranged in at least two rows.

A fifth aspect of the invention provides a triple-plate planar array antenna according to one of the second to fourth aspects, wherein a dummy element (10) is provided on said antenna circuit substrate (3) in such a way that said dummy slot opening (8) is positioned thereabove.

A sixth aspect of the present invention provides a triple-plate planar array antenna according to one of the second to the fifth aspects, wherein a feeder (110) is provided to said dummy element (10) formed on said antenna circuit substrate (3) so as to electrically short-circuit via a metal spacer (190*b*).

According to another embodiment of the present invention, there is provided a triple plate planar array antenna that is able to realize a uniform antenna characteristic between antennas in the center portion and those in the peripheral portion of the antenna array configured by arranging a plurality of compact-sized antennas therein.

A seventh aspect of the present invention provides a triple plate feeder-waveguide converter comprising a triple plate feeder composed of a film substrate (140) that has a strip feeder conductor (300) and is arranged on the surface of a ground plate (111) via a dielectric (120*a*) and an upper ground plate (150) arranged above the surface of the film substrate (140) via a dielectric (120*b*); and a waveguide (160) connected to the ground plate (111). There is provided in the ground plate (111) a through hole in a connection position thereof in which the ground plate (111) and the waveguide (160) are connected with each other, the through hole having the same inner dimension as the waveguide (160). A metal spacer portion (170*a*) having the same thickness as said dielectric (120*a*) is provided in a support portion of said film substrate (140). The film substrate (140) is interposed between said metal spacer portion (170*a*) and a metal spacer portion (170*b*) having the same dimension as said metal spacer (170*a*). An upper ground plate (150) is arranged on the upper end of the metal spacer portion (170*b*). A square resonance patch pattern (100) is provided at the tip portion of the strip feeder conductor (300) formed on said film substrate (140) in such a way that the center position of said square resonance patch pattern (100) coincides with the center position of the inner dimension of said waveguide (160).

An eighth aspect of the present invention provides a triple plate feeder-waveguide converter according to the seventh aspect, wherein a dimension L1 of the square resonance patch pattern (100) in a feeder connection direction is 0.27 times a free space wavelength $\lambda_0$ at a desired frequency and wherein a dimension L2 of the square resonance patch pattern (100) in a direction perpendicular to the feeder connection direction is 0.38 times the free space wavelength $\lambda_0$ at the desired frequency.

According to yet another embodiment, there is provided an inexpensive, easy-to-assemble triple plate feeder-waveguide converter that is able to make unnecessary the short-circuit metal plate 180 and the short-circuit length adjustment metal plate 190, both of which have been required in a conventional structure, without impairing a low loss characteristic that has been conventionally realized, and that has a high connection reliability. In addition, since constituting parts such as the metal spacer portions 170*a*, 170*b*, the upper ground plate 150, the ground plate 111, and the like are inexpensively produced by punching a metal plate with a desired thickness, the triple plate feeder-waveguide converter is inexpensively provided.

BRIEF DESCRIPTION OF DRAWINGS

In the accompanying drawings:

FIG. 2(*d*) is a cross-sectional view of stacked constituting parts.

FIG. 9(*b*) is a plane view of a connection plate of the planar antenna module according to the first embodiment of the present invention.

FIG. 15(*b*) is a front view of the triple plate array antenna according to the second embodiment.

FIG. 16(*b*) is a front view of the triple plate planar array antenna according to the second embodiment of the present invention.

FIG. 19(*b*) is a front view of the triple plate planar array antenna according to the second embodiment of the present invention.

FIG. 23(*b*) is a cross-sectional view of the prior art triple plate feeder-waveguide converter.

FIG. 23(*c*) is a cross-sectional view of another prior art triple plate feeder-waveguide converter.

FIG. 24(*d*) is a top view of the example of the short-circuit length adjustment metal plate used in a prior art converter.

FIG. 25(*b*) is a cross-sectional view of the example of a triple plate feeder-waveguide converter according to the third embodiment of the present invention.

BEST MODE FOR CARRYING OUT THE INVENTION

First Embodiment

Figure 1:
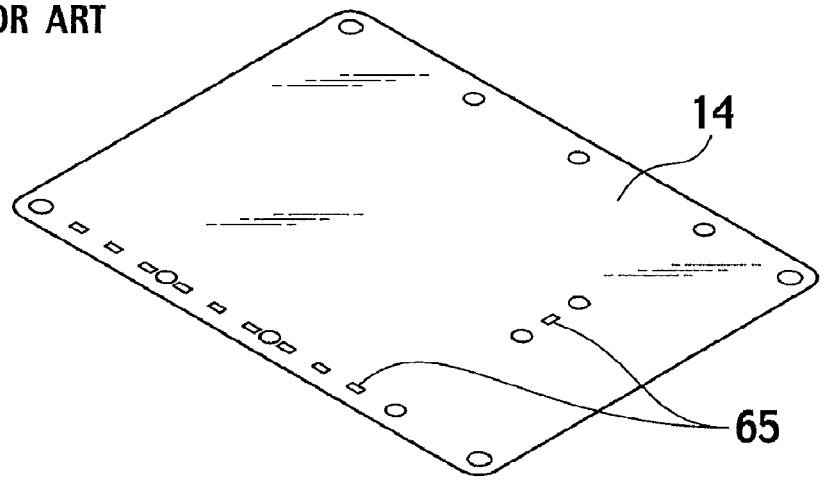
FIG. 1 is a perspective view of constituting parts of a prior art planar antenna module.
Figure 1:
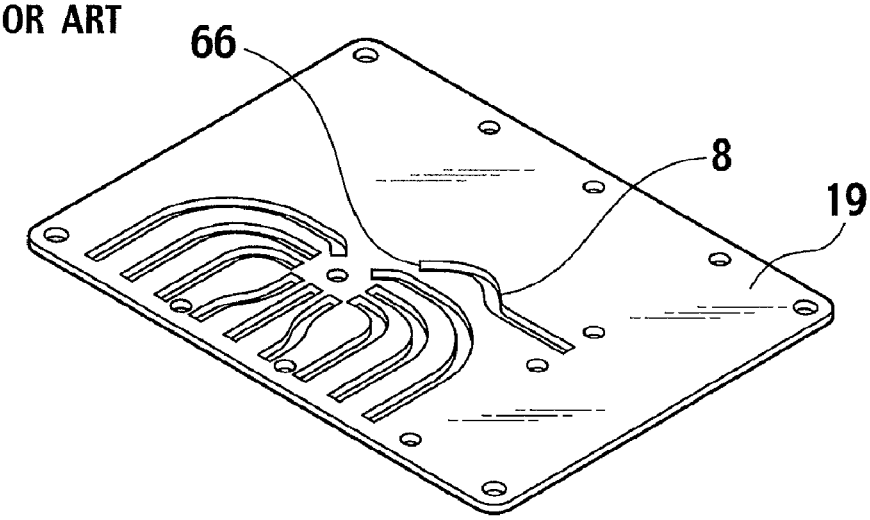
Figure 2:
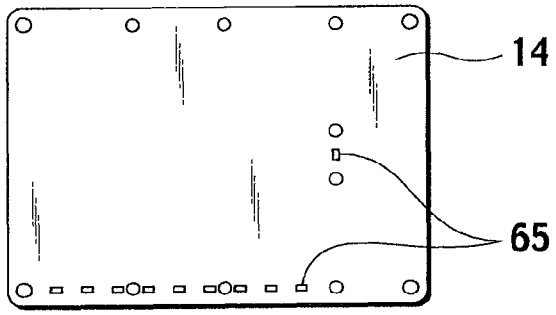
FIGS. 2(*a*) to 2(*c*) are a plane view of constituting parts of a prior art planar antenna module.
Figure 2:
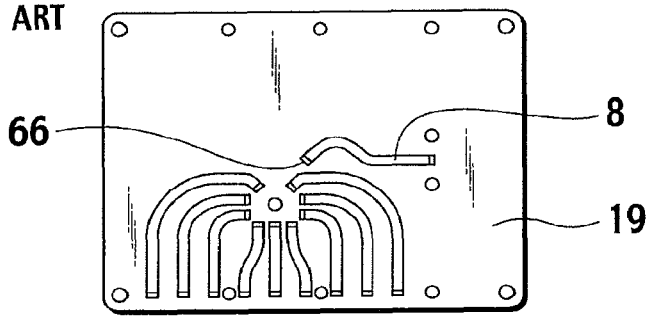
Figure 2:
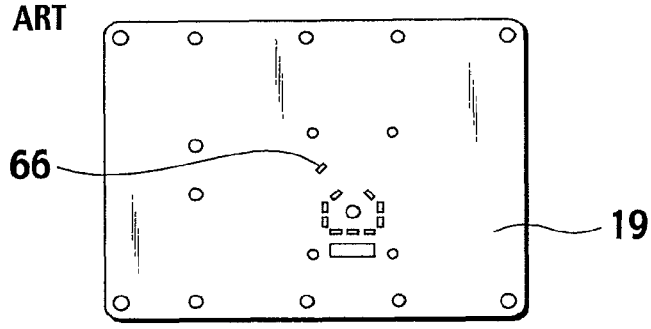
Figure 2:
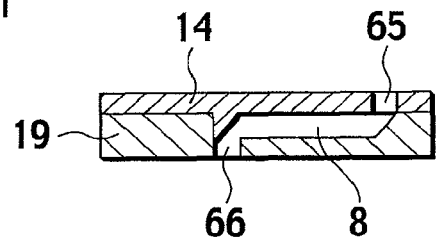
Figure 3:
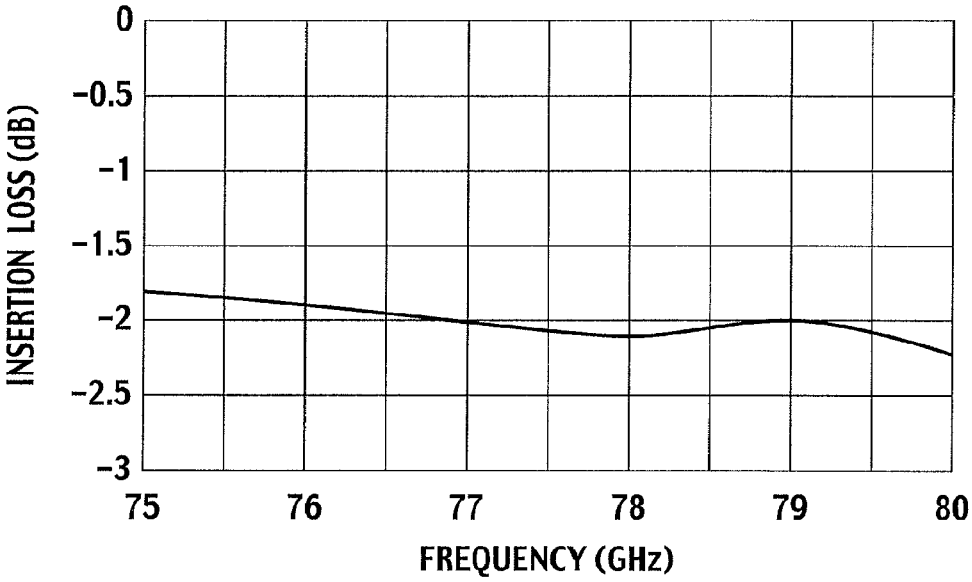
FIG.3 PRIOR ART
FIG. 3 is an insertion loss characteristic of a prior art planar antenna module.
Figure 4:
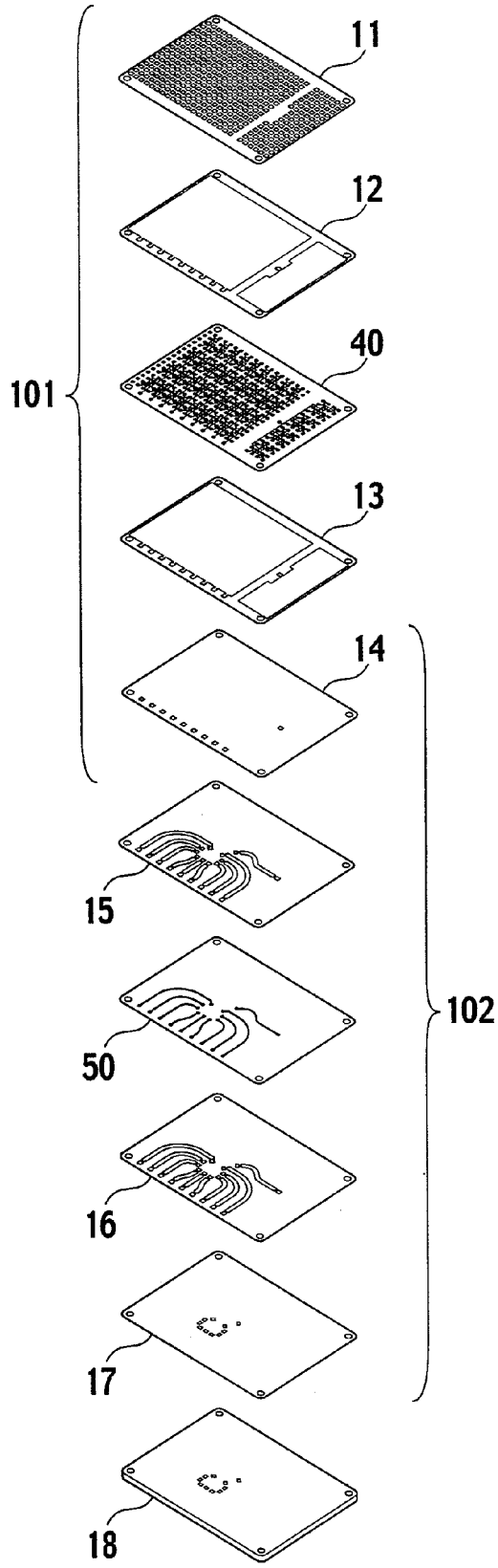
FIG. 4 is a perspective view of a planar antenna module according to a first embodiment of the present invention.
Figure 5:
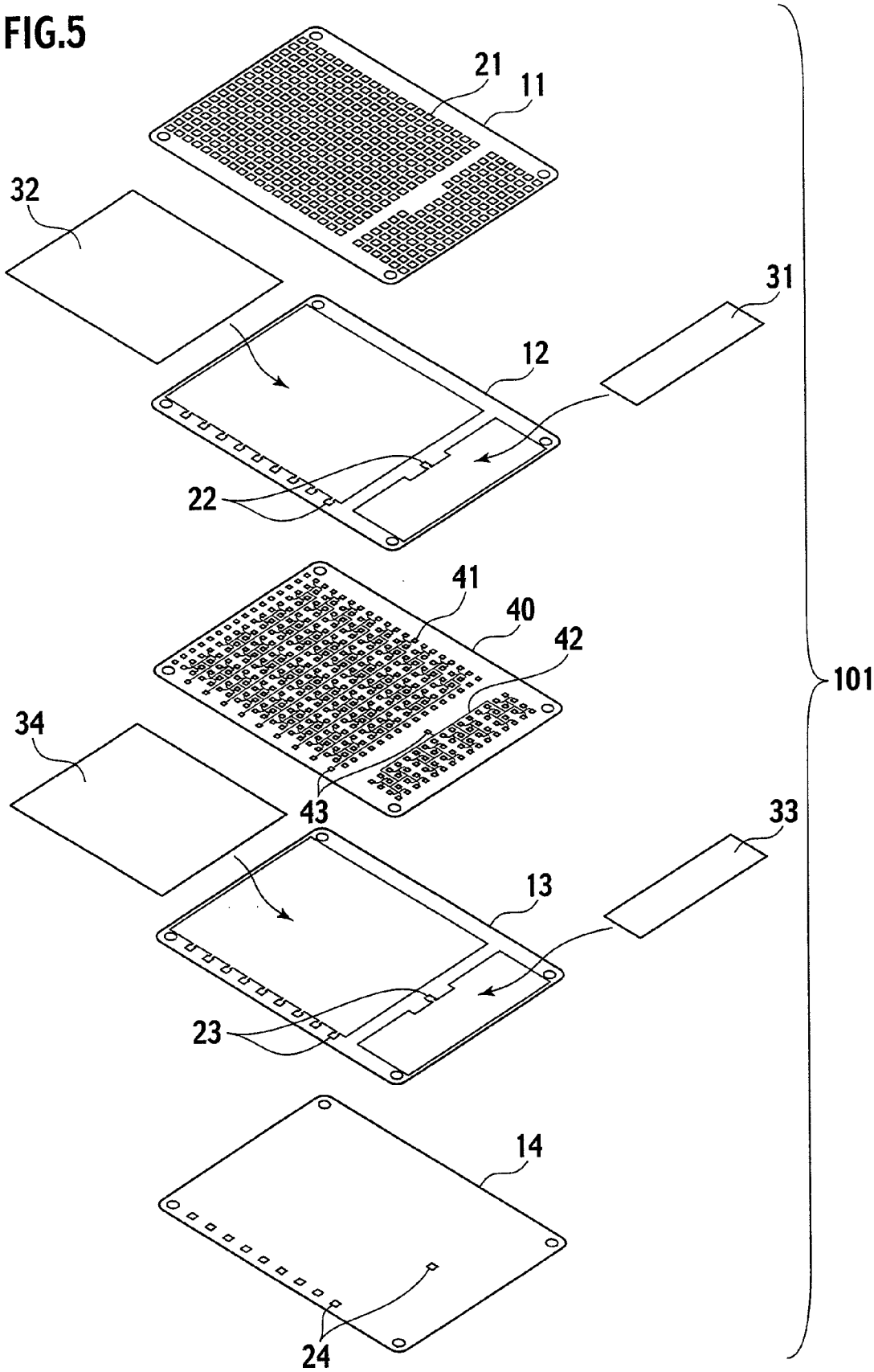
FIG. 5 is a perspective view of constituting parts of an antenna portion of the planar antenna module.
Figure 6:
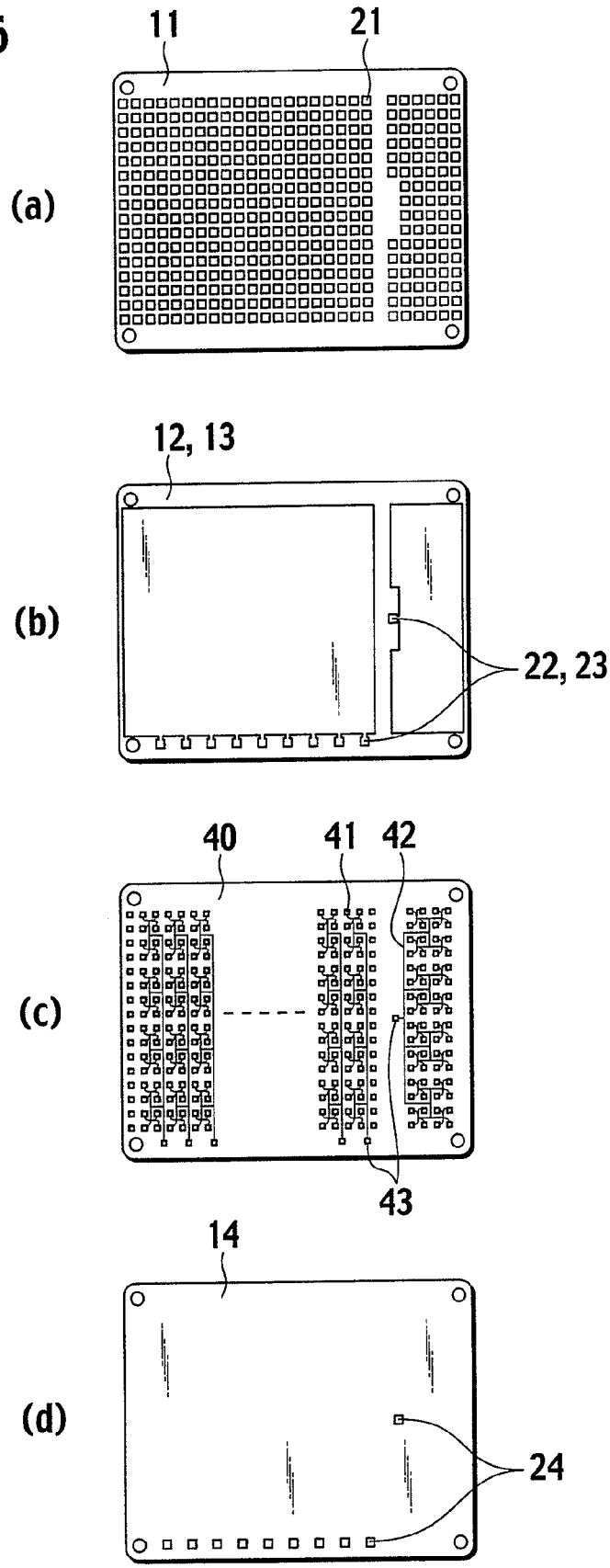
FIGS. 6(*a*), 6(*b*), 6(*c*) and 6(*d*) are plane views of constituting parts of an antenna portion of the planar antenna module according to the first embodiment of the present invention.
Figure 7:
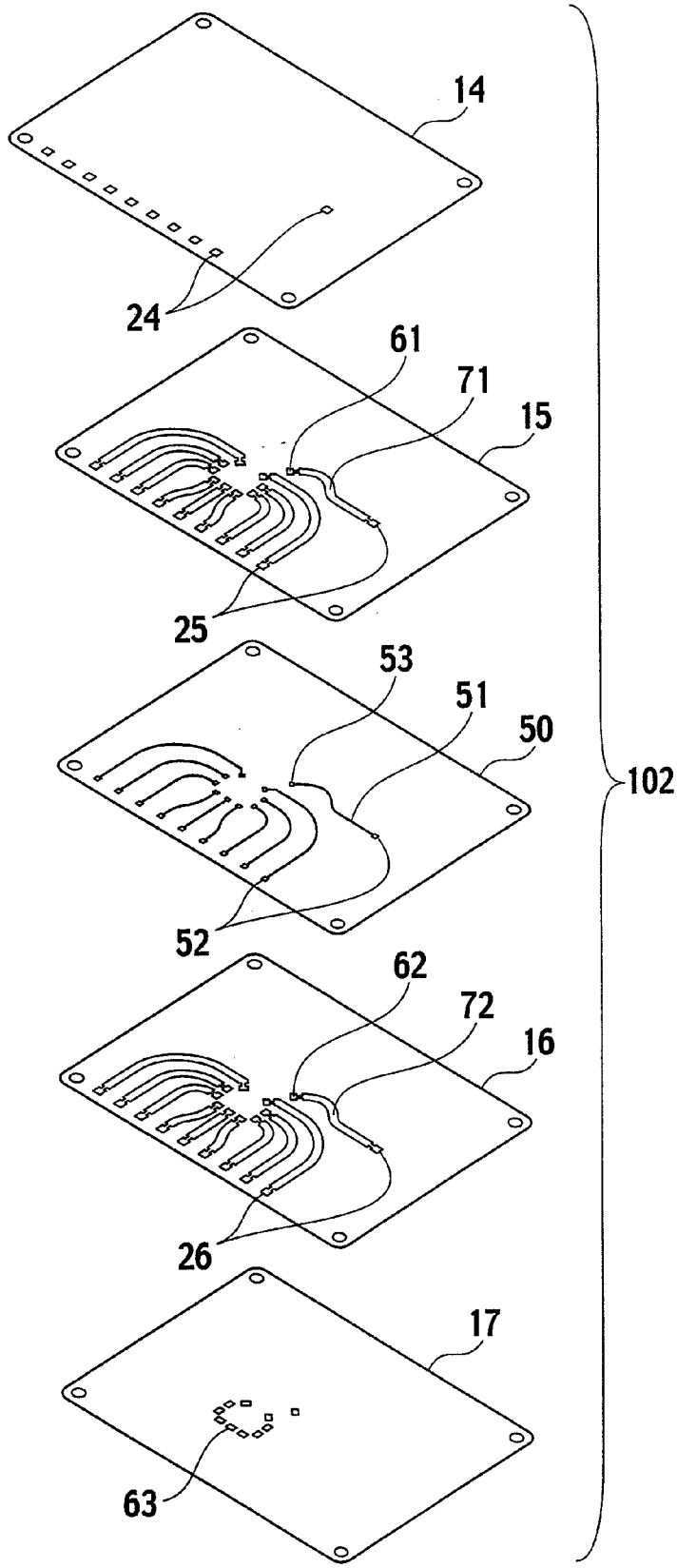
FIG. 7 is a perspective view of constituting parts of a feeder portion of the planar antenna module according to the first embodiment of the present invention.
Figure 8:
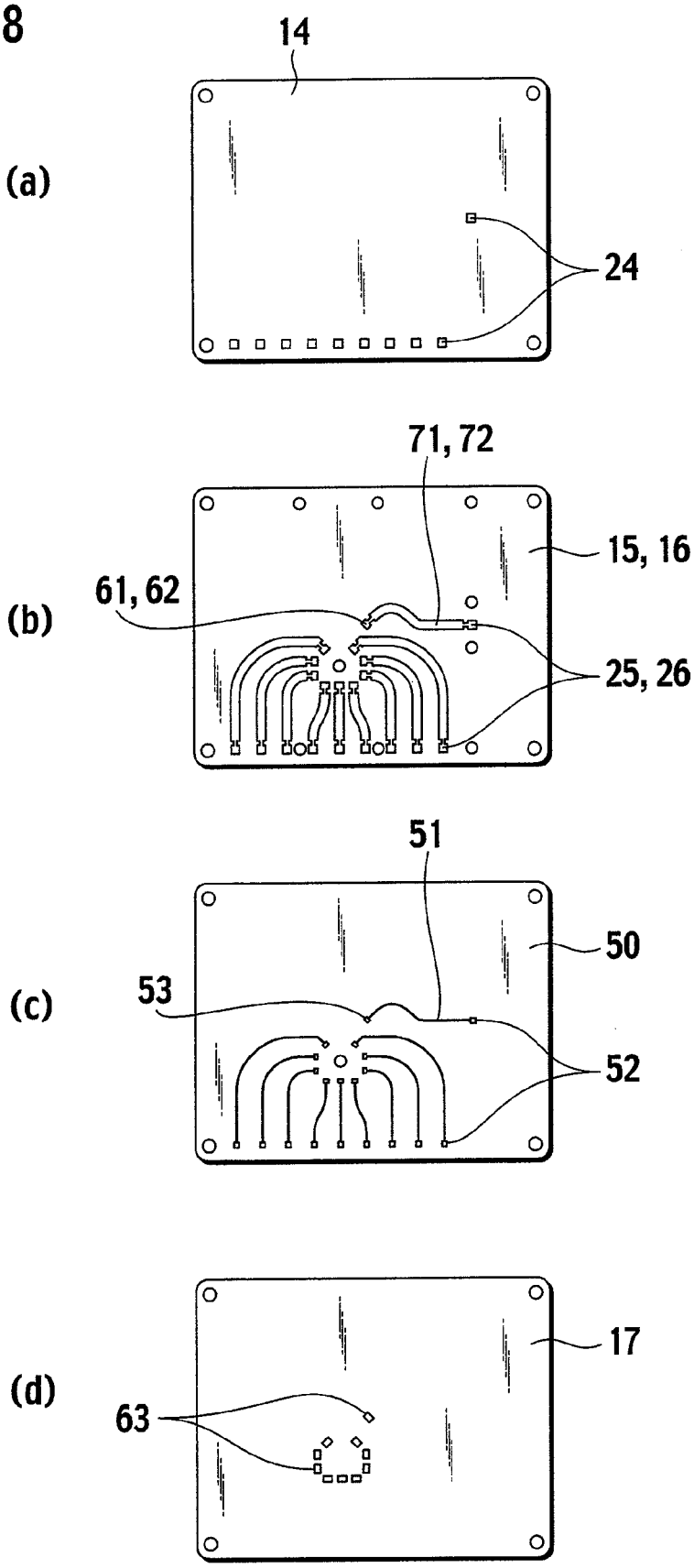
FIGS. 8(*a*), 8(*b*), 8(*c*) and 8(*d*) are plane views of constituting parts of a feeder portion of the planar antenna module according to the first embodiment of the present invention.
Figure 9:
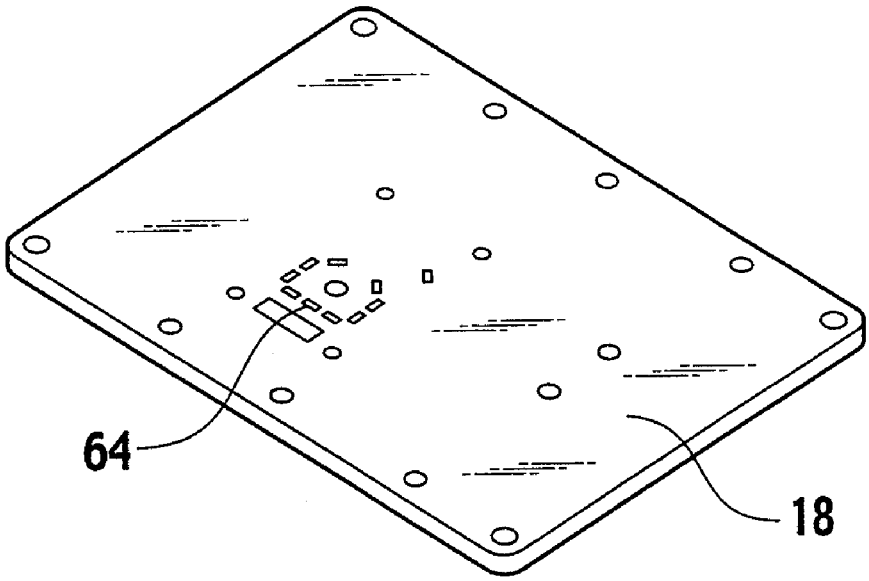
FIG. 9(*a*) is a perspective view of a connection plate of the planar antenna module according to the first embodiment of the present invention.
Figure 9:
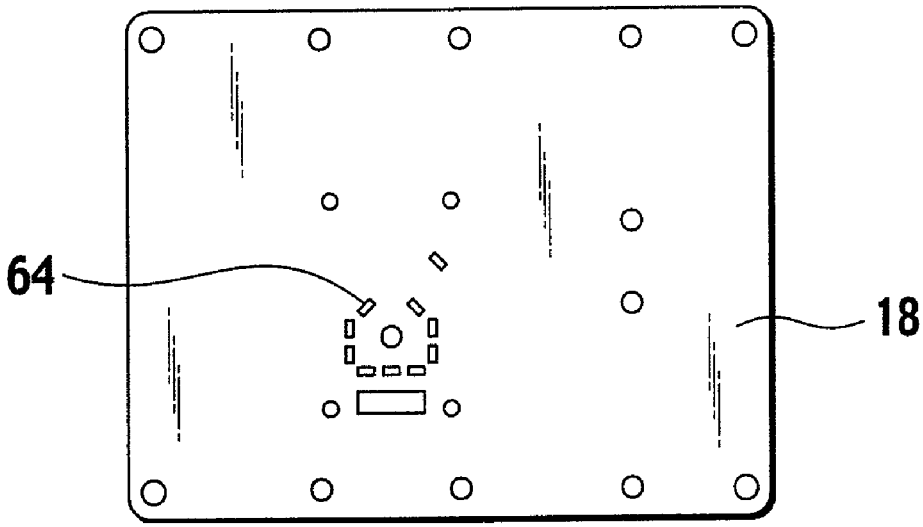
Figure 10:
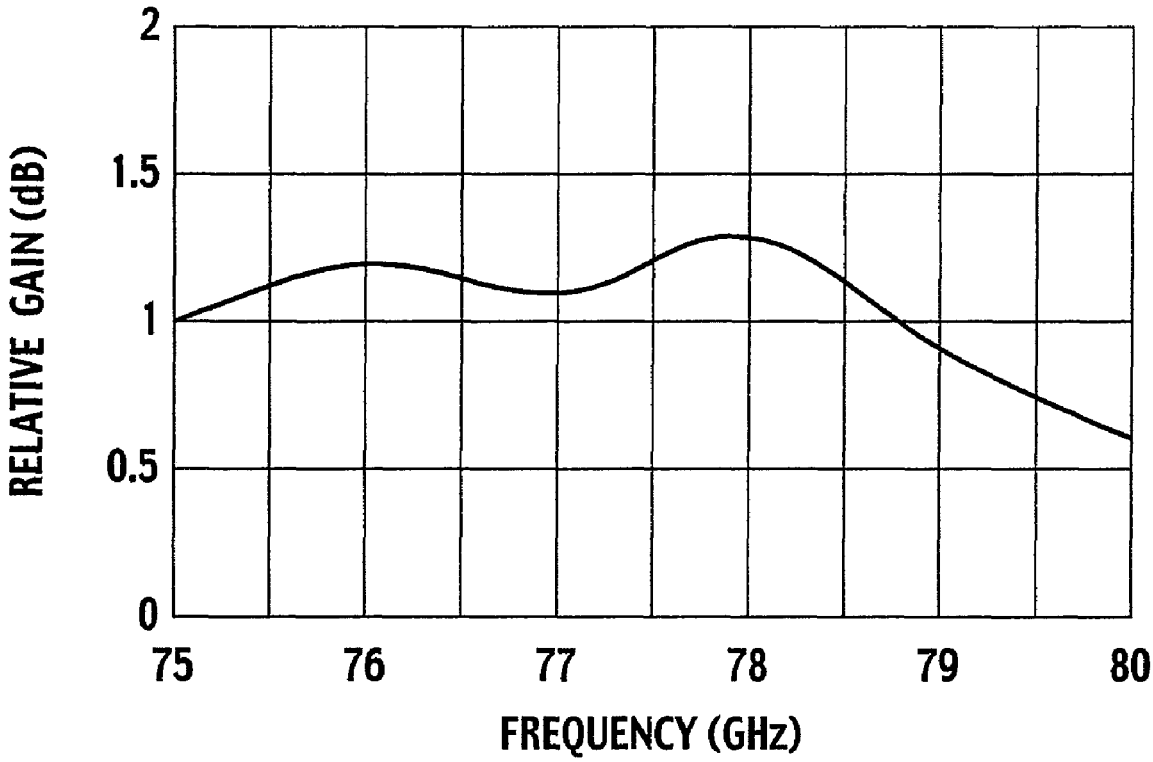
FIG. 10 is a graph illustrating a relative gain of the planar antenna module according to the first embodiment of the present invention in comparison with a prior art antenna module.
Figure 11:
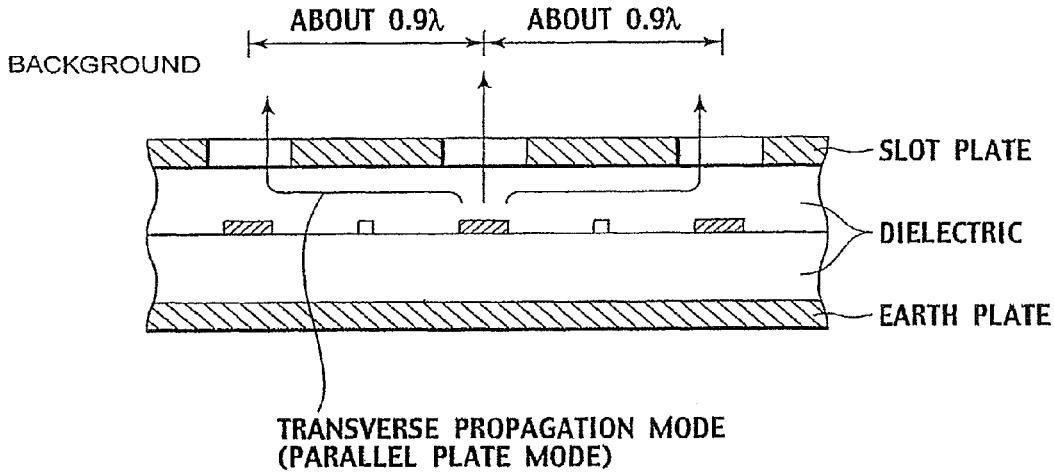
FIG. 11 is an explanatory view of traverse direction component of electromagnetic wave in a triple plate planar antenna used for investigation purposes.
Figure 12:
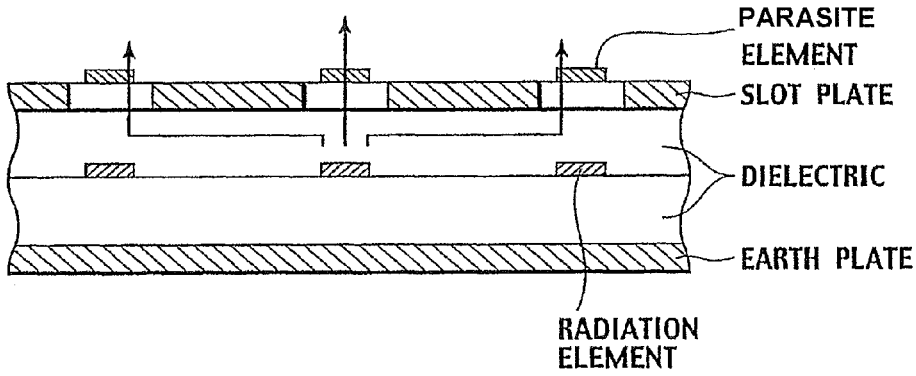
FIG. 12 illustrates one method of reducing traverse direction component in the planar antenna.
Figure 13:
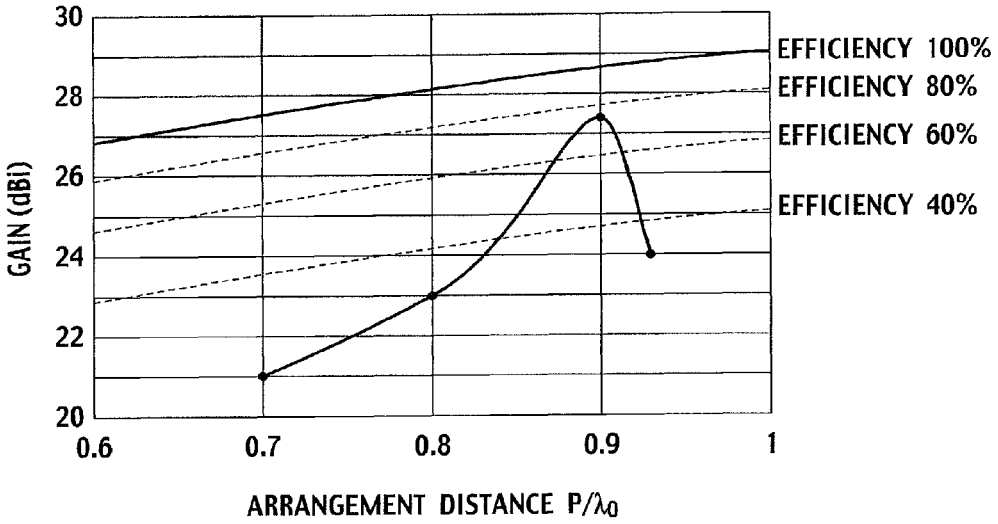
FIG.13 PRIOR ART
FIG. 13 is a diagram representing a relation between arrangement intervals of antenna elements and a gain and efficiency in a prior art planar antenna.
Figure 14:
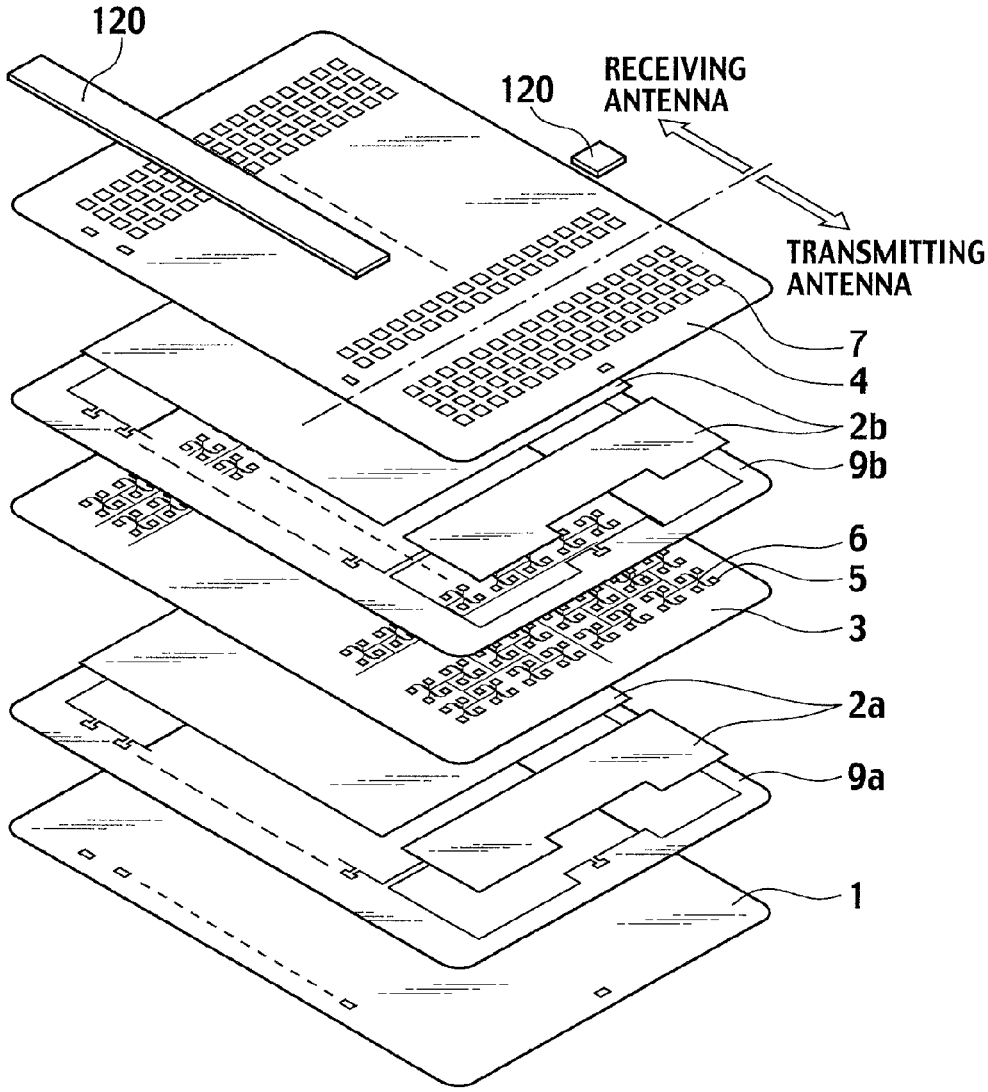
FIG.14 PRIOR ART
FIG. 14 is an exploded perspective view illustrating the prior art planar antenna.

Referring to FIGS. 4, 5, and 7, in the planar antenna module according to the first embodiment of the present invention, the radiation element 41 serves as an antenna element along with the fourth ground plate 14 and the first slot 21 formed in the first ground plate 11 and is able to take in energy having a predetermined frequency. The energy is transferred to the first connection portion 43 by the first feeder 42 formed on the antenna substrate 40. The energy is then transferred to the second feeder 51 because the first connection portion 43 formed in the antenna substrate 40 is electromagnetically coupled with the second connection portion 52 formed in the feed substrate 50 via the second slot 24 formed in the fourth ground plate 14.

In this case, the first connection port formation portion 22 formed in the second ground plate 12, the second connection port formation portion 23 formed in the third ground plate 13, the third connection port formation portion 25 formed in the fifth ground plate 15, and the third connection port formation portion 26 formed in the sixth ground plate 16 contribute to efficient transfer of the power that is electromagnetically coupled from the first connection portion 43 formed in the antenna substrate 40 to the second connection portion 52 formed in the feed substrate 50 without causing leakage to the surrounding area.

In addition, the power that has been transferred to the second feeder 51 is transferred to the second waveguide opening 64 formed in the connection plate 18 connected to the high frequency circuit via the first waveguide opening portion 63 formed in the seventh ground plate 17 by the third connection portion 53 formed in the feed substrate 50. At this time, the first waveguide opening formation portion 61 formed in the fifth ground plate 15 and the second waveguide opening formation portion 62 formed in the sixth ground plate 16 contribute to efficient transfer of the power from the third connection portion 53 formed in the feed substrate 50 to the second waveguide opening portion 64 without causing leakage to the surrounding area.

The first dielectric 31, the second dielectric 32, and the second ground plate 12, and also the third dielectric 33, the fourth dielectric 34, and the third ground plate 13 support the antenna substrate 40 surely between the first ground plate 11 and the fourth ground plate 14, thereby realizing a low loss characteristic in the first feeder 42 even at a high frequency.

Similarly, the fifth ground plate 15 and the sixth ground plate 16 support the feed substrate 50 surely between the fourth ground plate 14 and the seventh ground plate 17. In addition, a low loss characteristic can be realized in the second feeder 51 even at a high frequency and by low dielectric properties by the air gap portion 71 formed in the fifth ground plate 15 and the air gap portion 72 formed in the sixth ground plate 16.

The planar antenna module according to this embodiment is configured by stacking each constituting part. Since the power transfer is realized by electromagnetic coupling, positional precision in assembling is not necessarily high compared with one required in the past.

The antenna substrate 40 and the feed substrate 50 used in this embodiment can be made of a flexible substrate in which a copper foil is attached on a polyimide film. When using this, an unnecessary portion of the copper foil is eliminated by etching to form the radiation element 41, the first feeder 42 and the first connection portion 43, and also the second feeder 51, the second connection portion 52 and the third connection portion 53.

By the way, the flexible substrate is used in order to form a plurality of radiation elements and feeders for connecting the elements by etching off an unnecessary portion of the copper foil (metal foil) that has been attached on the film as a base material. In addition, the flexible substrate can be a copper-laminated plate in which a copper foil is attached on a thin resin plate obtained by impregnating a resin to a glass cloth.

The ground plate used in this embodiment can be made of a metal plate or a metal-plated plastic plate. Specifically, an aluminum plate is preferably used because a use of it makes possible a lightweight and less expensive planar antenna. In addition, the ground plate may be made of a flexible plate in which a copper foil is attached on a film as a base material, or a copper-laminated plate in which a copper foil is attached on a thin resin plate made by impregnating a resin to a glass cloth. The slot or connection port formation portion can be made by mechanical press or by etching. From a viewpoint of convenience and productivity or the like, punching by mechanical press is preferable.

As the dielectric used in this embodiment, a foamed material having a low permittivity relative to air is preferably used. Polyolefin foamed materials such as polyethylene (PE) and polypropylene (PP), polystyrene foamed materials, polyurethane foamed materials, polysilicone foamed materials, and rubber foamed materials are cited as the foamed material. Among them, polyolefin foamed materials are more preferable because of a low permittivity relative to air.

Example 1

An example according to the first embodiment is described with reference to FIGS. 4, 5, and 7.

The first ground plate 11, and the fourth plate 14 were made of an aluminum plate of 0.7 mm thick. The second ground plate 12, the third ground plate 13, the fifth ground plate 15, the sixth ground plate 16, and the seventh ground plate 17 were made of an aluminum plate of 0.3 mm thick. The (circuit) connection plate 18 was made of an aluminum plate of 3 mm thick. The dielectrics 31, 32, 33, 34 were made of foamed polyethylene having a relative permittivity of 1.1 relative to air and a thickness of 0.3 mm. The antenna substrate 40 and the feed substrate 50 were made using a flexible substrate in which a copper foil has been attached on a polyimide film. Specifically, the antenna substrate 40 was made by etching off an unnecessary portion of the copper foil to form the radiation elements 41, the first feeders 42, the first connection portions 43, the second feeders 51, the second connection portions 52, and the third connection portions 53. The ground plates are made by punching an aluminum plate by mechanical press.

In this case, the radiation elements 41 each have a shape of a 1.5-mm-square which is 0.38 times the free space wavelength ($\lambda_0$=3.95 mm) at a frequency of 76 GHz. The first slots 21 formed in the first ground plate 11 and the second slots 24 formed in the fourth ground plate 14 each have a shape of a 2.3-mm-square which is 0.58 times the free space wavelength ($\lambda_0$=3.95 mm) at a desired frequency of 76 GHz. The first connection port formation portion 22 formed in the second ground plate 12, the second connection port formation portion 23 formed in the third ground plate 13, the third connection port formation portion 25 formed in the fifth ground plate 15 and the fourth connection port formation portion 26 formed in the sixth ground plate 16 have an side of 2.3 mm long which is 0.58 times the free space wavelength ($\lambda_0$=3.95 mm) at a desired frequency of 76 GHz.

Moreover, the sixth ground plate 16, the fifth ground plate 15, the seventh ground plate 17, the third ground plate 13, the third dielectric 33, the fourth dielectric 34, the second ground plate 12, the first dielectric 31, and the second dielectric 32 have a thickness of 0.3 mm which is 0.08 times the free space wavelength ($\lambda_0$=3.95 mm) at a frequency of 76 GHz.

Each member described above was stacked in the order as illustrated in FIGS. 4, 5, and 7 to configure the planar antenna module. When received power was measured by connecting a measurement apparatus thereto, a reflection loss of −15 dB or less was obtained and also a reception gain was improved by 1 dB or more in terms of a relative gain compared with conventional configurations as reference, which is indicative of an excellent characteristic.

Second Embodiment

Figure 15:
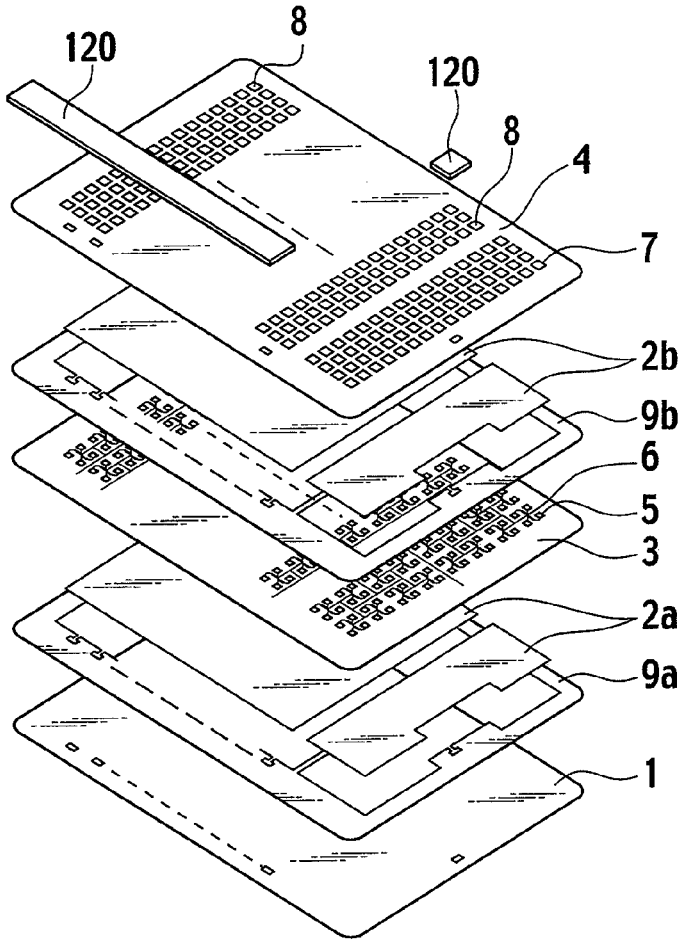
FIG. 15(*a*) is an exploded perspective view illustrating a triple plate array antenna according to a second embodiment.
Figure 15:
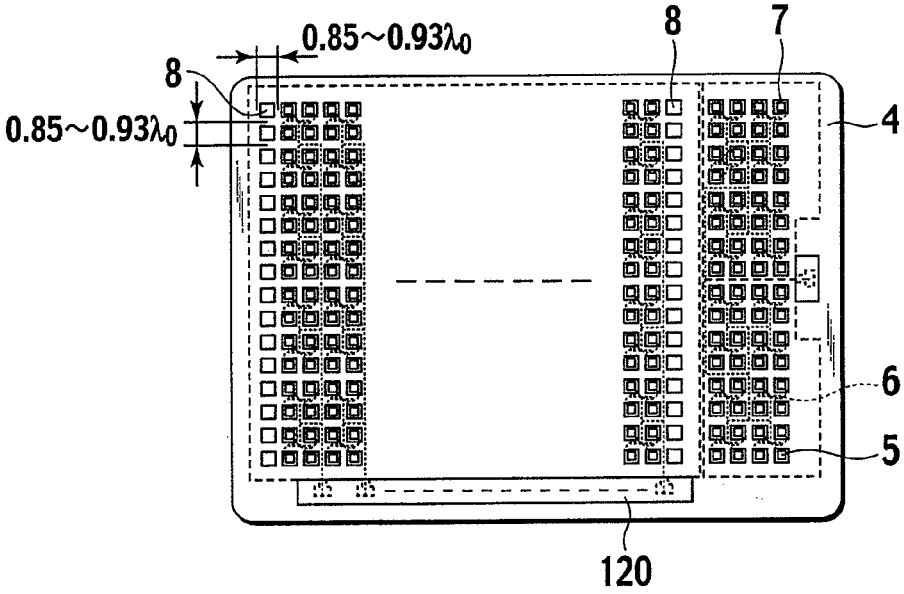

A planar array antenna according to a second embodiment is characterized in that dielectrics 2*a*, 2*b* and metal spacers 9*a*, 9*b* having the same thickness are provided as a metal shield portion so as to sandwich an antenna circuit substrate 3 therebetween, and dummy slot openings 8 adjacent to a slot opening 7 in a slot plate 4 are provided, as illustrated in FIG. 15(*a*).

Another planar array antenna according to this embodiment is characterized in that an arrangement distance of the dummy slot openings 8 concerned is from 0.85 to 0.93 times the free space wavelength $\lambda_0$ of the center frequency of a frequency band to be used, as illustrated in FIG. 15(*b*).

Figure 16:
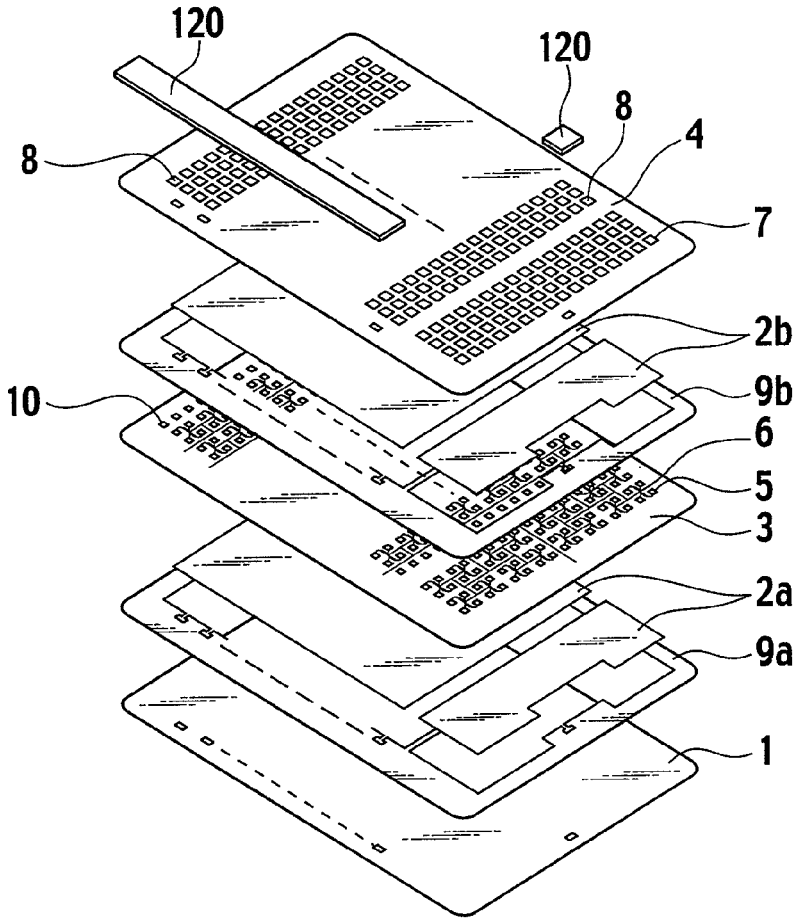
FIG. 16(*a*) is an exploded perspective view illustrating a triple plate planar array antenna according to the second embodiment of the present invention.
Figure 16:
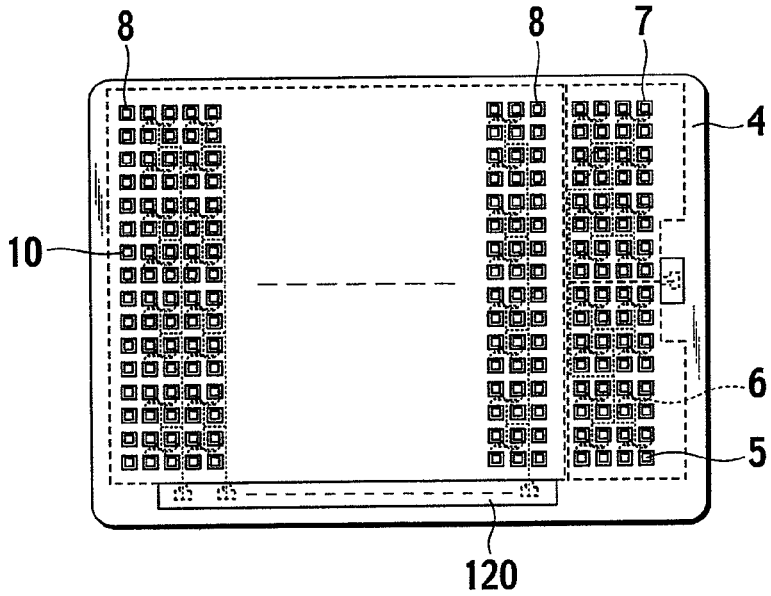
Figure 17:
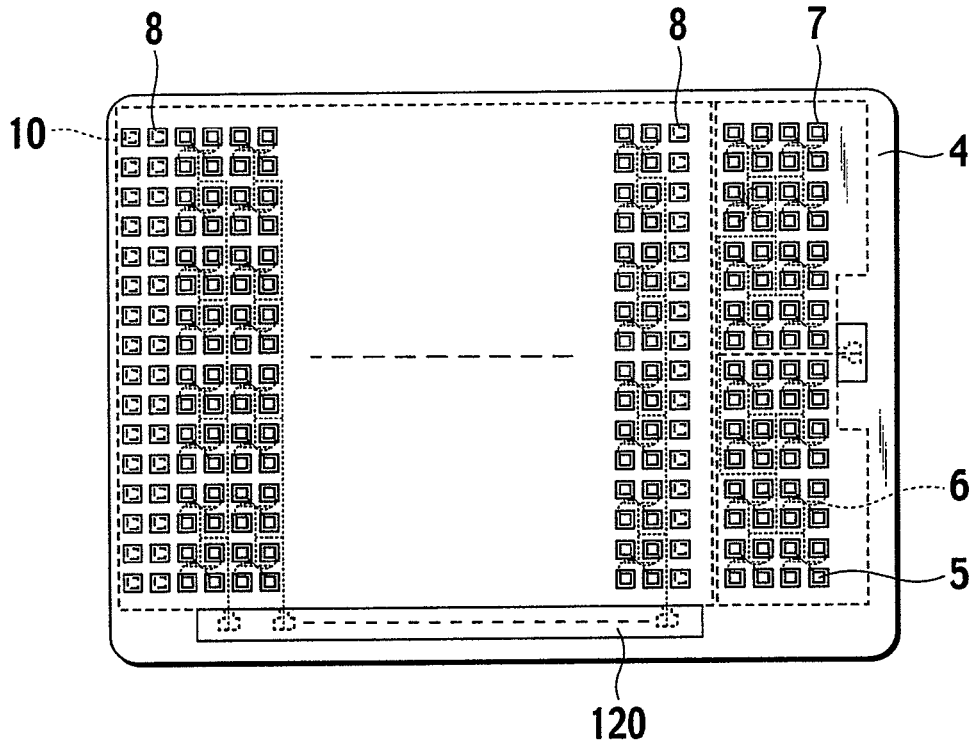
FIG. 17 is a front view of the triple plate planar array antenna according to the second embodiment of the present invention.
Figure 18:
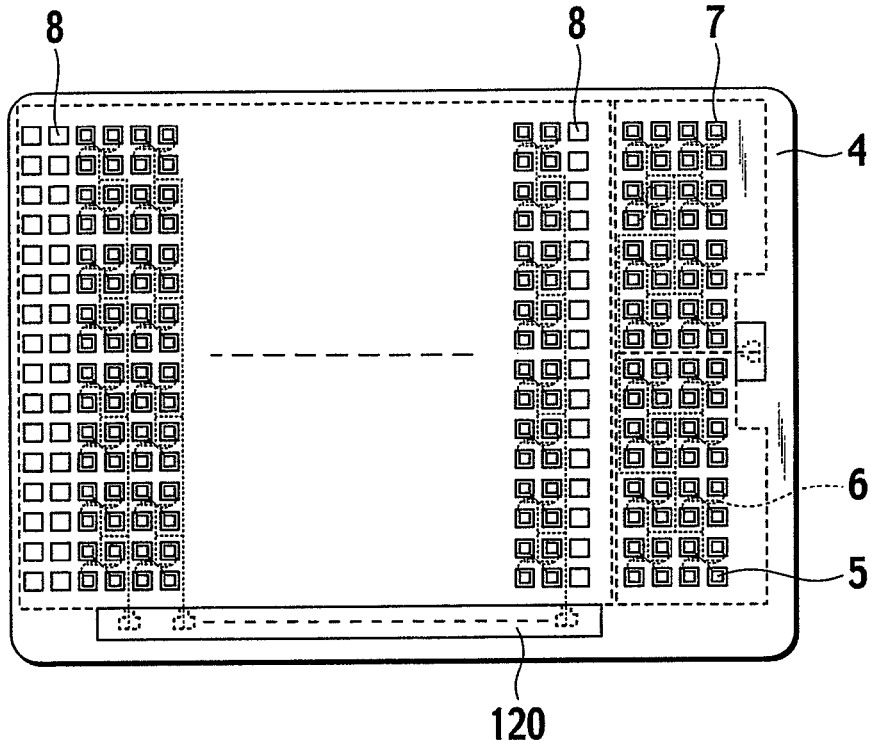
FIG. 18 is another front view of the triple plate planar array antenna according to the second embodiment of the present invention.

Yet another planar array antenna according to this embodiment is characterized in that dummy elements 10 that are similar to the radiation elements 5 in terms of size are provided on the antenna circuit substrate 3 so that the dummy slot openings 8 are positioned directly thereabove, as illustrated in FIGS. 16(*a*), 16(*b*), and 17.

Figure 19:
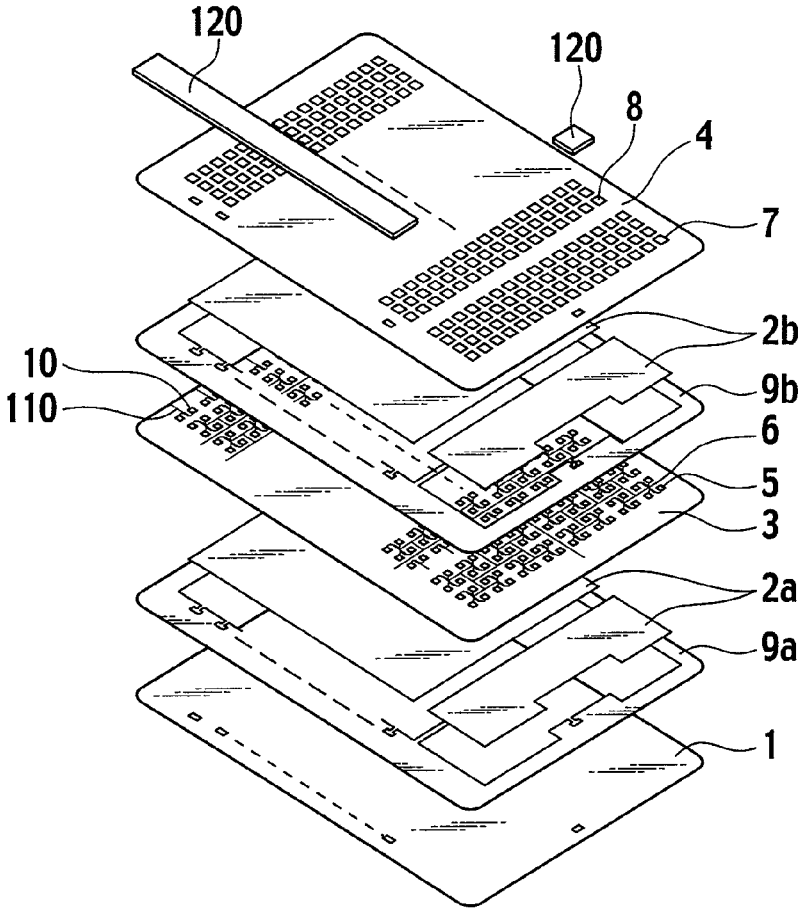
FIG. 19(*a*) is an exploded perspective view illustrating the triple plate planar array antenna according to the second embodiment of the present invention.
Figure 19:
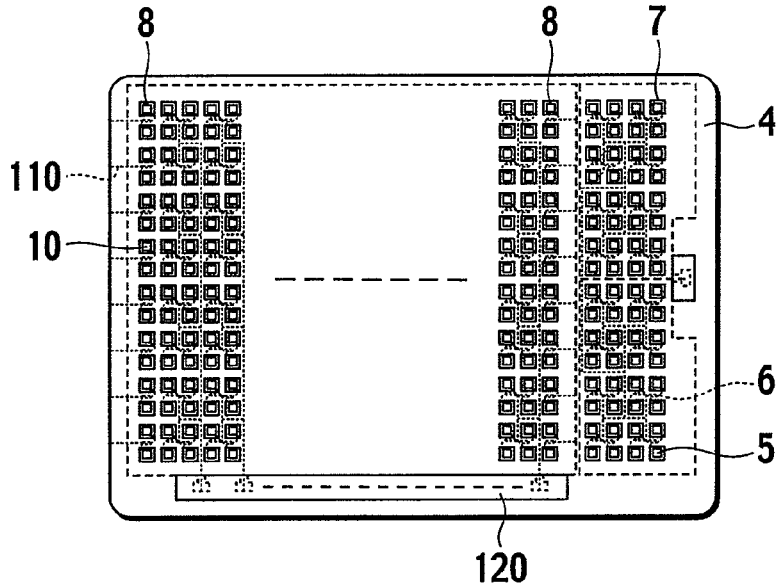
Figure 20:
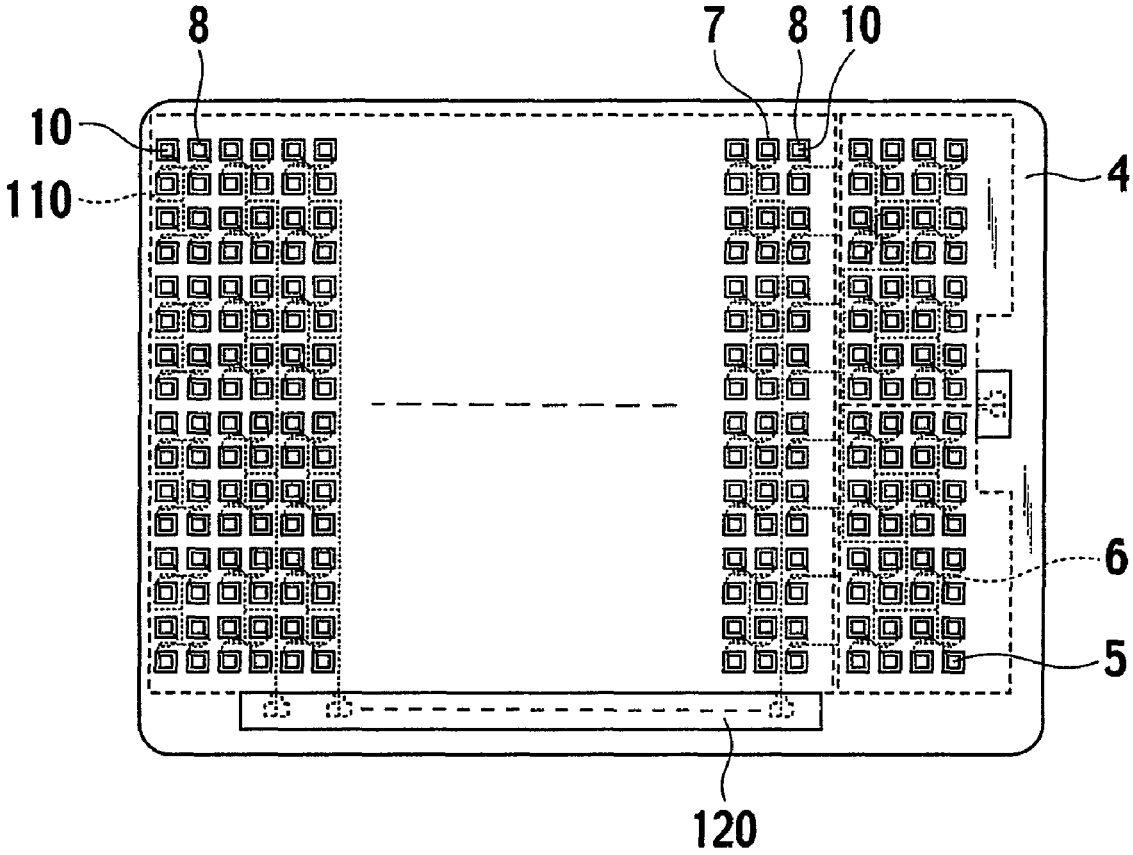
FIG. 20 is a yet another front view of the triple plate planar array antenna according to the second embodiment of the present invention.
Figure 21:
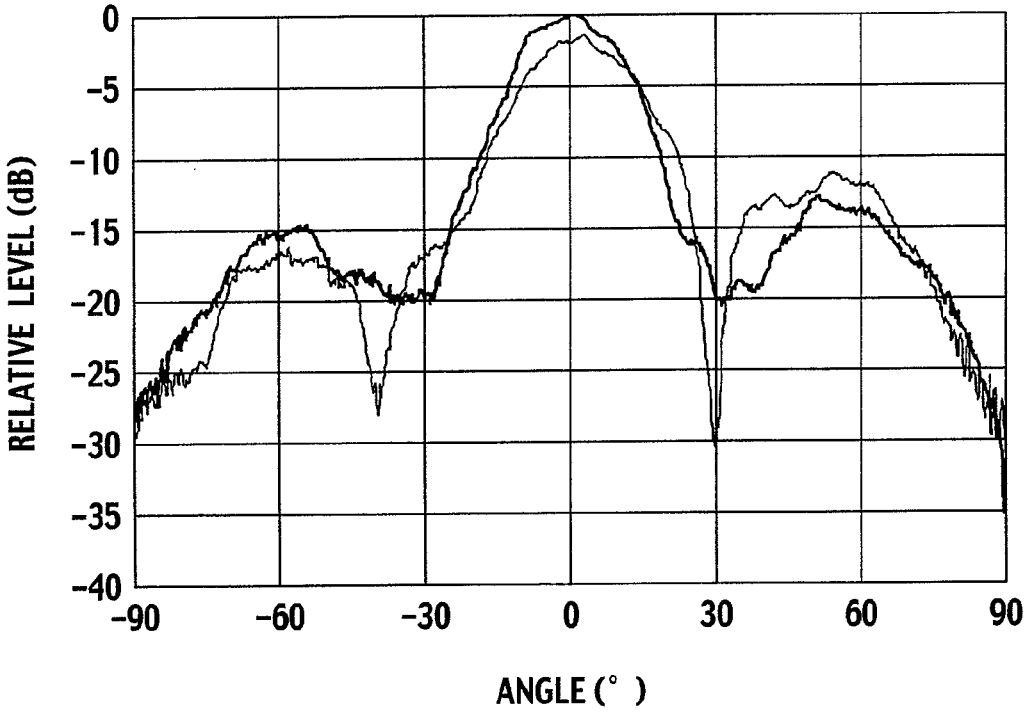
FIG. 21 is a diagram representing antenna directivities of an antenna element in a center portion and in a peripheral portion of a prior art receiving antenna array.

Still another planar array antenna according to this embodiment is characterized in that there is provided a feeder 110 to the dummy elements 10 provided on the antenna circuit substrate 3 so that the dummy elements 10 are short-circuited via the metal spacer 9*b*, as illustrated in FIGS. 19(*a*), 19(*b*), and 20.

Yet still another planar array antenna according to this embodiment is characterized in that at least two rows of the dummy slot openings 8 concerned are disposed.

The ground plate 1 and the slot plate 4 can be made of any metal plates or metal-plated plastic plates. When they are made of specifically an aluminum plate, it is possible to make the planar antenna lightweight and inexpensive. In addition, the ground plate 1 and the slot plate 4 each can be configured by etching off an unnecessary portion of a copper foil of a flexible substrate that has the copper foil attached on a film as a base material. Moreover, they can be configured by a copper-laminated plate in which a copper foil is attached on a thin resin plate obtained by impregnating a resin to a glass cloth. The slots or the like formed in the ground plate are made by punching with a mechanical press apparatus or by etching. From a viewpoint of convenience and productivity or the like, mechanical press punching is preferable.

As dielectrics 2*a*, 2*b*, air or a foamed material having a low permittivity relative to air, or the like is preferably used. Specifically as the foamed material, polyolefin foamed materials such as polyethylene (PE) and polypropylene (PP), polystyrene foamed materials, polyurethane foamed materials, polysilicone foamed materials, and rubber foamed materials are cited. Among them, polyolefin foamed materials are more preferable because of a low permittivity relative to air.

The antenna substrate 3 is configured by etching off an unnecessary portion of a copper foil of a flexible substrate in which the copper foil has been attached on the face of a film as a base material so as to form the radiation element 5 and feeder 6. However, the antenna substrate 3 can be configured using a copper-laminated plate in which a copper foil is attached on a thin resin plate obtained by impregnating a resin to a glass cloth.

By the way, the radiation element 5 and the slot opening 7 may have a shape of a rhombus, a square, or a circle.

Example 2

Referring to FIGS. 15(*a*) and 15(*b*), an example according to the second embodiment of the present invention is described.

The ground plate 1 was made of an aluminum plate of 1 mm thick. The dielectrics 2*a*, 2*b* were made of a foamed polyethylene plate having a relative permittivity of about 1 and a thickness of 0.3 mm. The antenna circuit substrate 3 was made by using a film substrate in which a copper foil of 18 micrometers thick had been attached on a polyimide film of 25 micrometers thick and by etching off the copper foil so as to form a plurality of the radiation elements 5 and the feeders 6. The radiation elements 5 were square-shaped in this example and the length of the side thereof was about 0.4 times the free space wavelength $\lambda_0$ at a frequency of 76.5 GHz to be used. The slot plate 4 is made by punching an aluminum plate of 1 mm thick by a pressing method so as to form a plurality of rectangular slot openings 7. The shorter side of the slot openings 7 is about 0.55 times the wavelength $\lambda_0$. Here, the radiation elements 5 and the slot openings 7 were arrayed at intervals of about 0.9 times the wavelength $\lambda_0$.

By the way, as a conversion methodology in the output end of each antenna element, a waveguide conversion is utilized and the conversion is to be realized by the short plate 120.

In the above configuration, one 4-by-16 element antenna was configured as a transmitting antenna and nine 2-by-16 element antennas were configured as a receiving antenna.

In addition, there were provided in the slot plate 4 a pair of 1-by-16 dummy slot openings 8, each opening 8 having the same opening dimension as the slot openings 7, in such a way that the nine receiving antennas 9 are interposed by the pair (see FIG. 15(*b*)). The dummy slot openings 8 are disposed by the same intervals as the slot openings 7, that is $0.9\lambda_0$.

Figure 22:
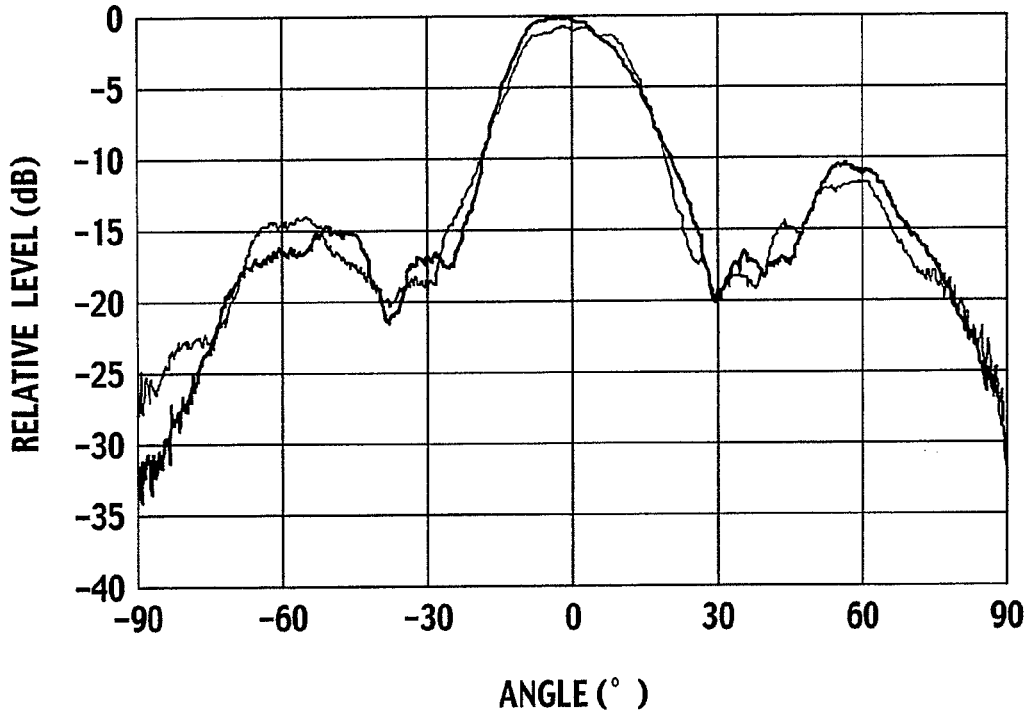
FIG. 22 a diagram representing antenna directivities of an antenna element in a center portion and in a peripheral portion of a receiving antenna array of the triple plate planar array antenna according to the second embodiment.

The planar array antenna configured as described above can realize balanced directivities as illustrated in FIG. 22, whereas a conventional planar array antenna can only realize unbalanced horizontal directivities between in a central portion and in a peripheral portion of the receiving antenna as illustrated in FIG. 22.

Example 3

In an example 3 illustrated in FIGS. 16(*a*) and 16(*b*), there are provided a plurality of dummy elements 10 having the same side length of about 0.4 times the wavelength $\lambda_0$ in such a way that the dummy slot openings 8 described in the example 2 are respectively positioned right above the elements 10.

As a result, substantially the same horizontal directivity is realized both in a center portion and in a peripheral portion of the antenna array of the receiving antenna, as is the case with the example 2.

Example 4

In an example 4 illustrated in FIGS. 19(*a*) and 19(*b*), a feeder 110 is provided to the dummy elements 10 described in the example 3 and connected electrically to the slot plate 4.

As a result, substantially the same horizontal directivity is realized both in a center portion and a peripheral portion of the antenna array of the receiving antenna, as is the case with the examples 2 and 3.

As described above, according to this embodiment, there is obtained a triple plate planar array antenna in which antenna gain and directivity by antenna elements formed in a peripheral portion of an antenna array are kept substantially the same as those by antenna elements formed in a center portion of the antenna array.

Third Embodiment

Figure 24:
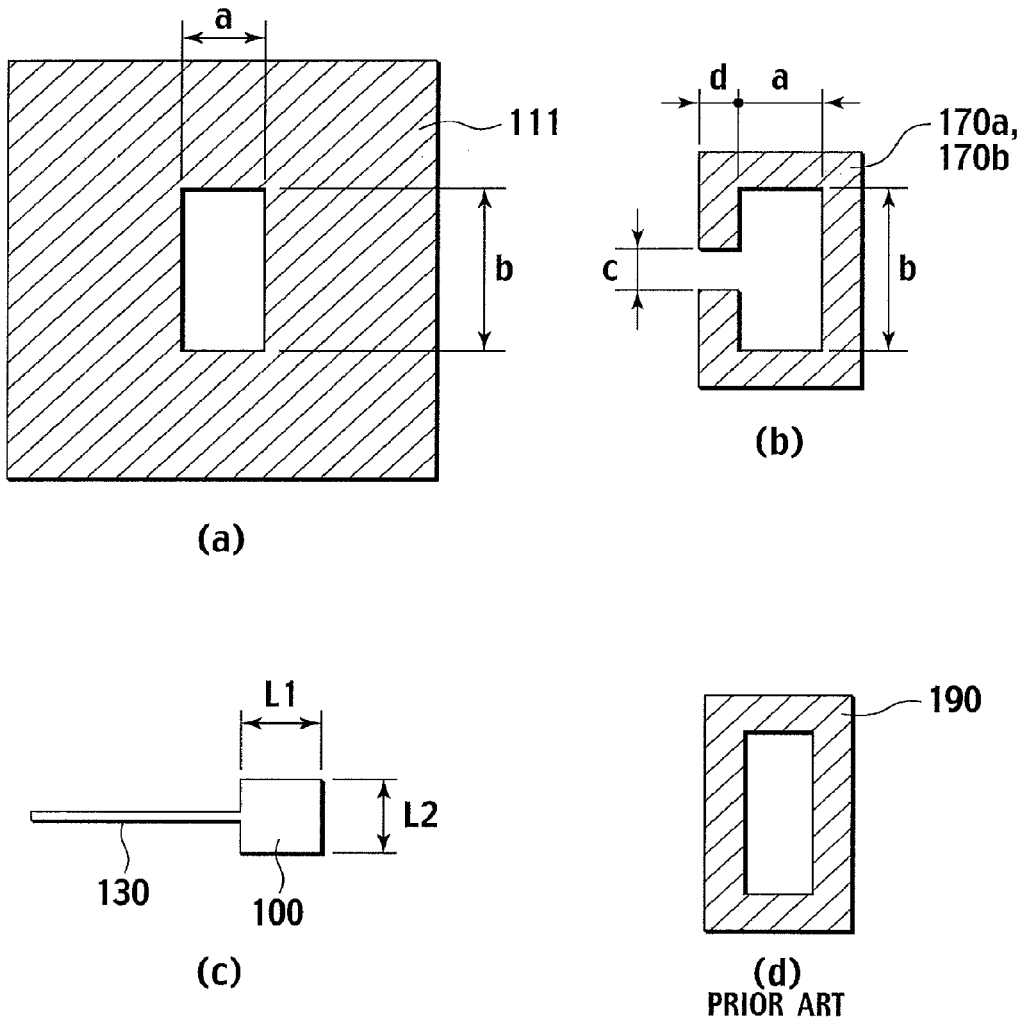
FIGS. 24(*a*) to 24(*c*) are a top view of a part of an example of a triple plate feeder-waveguide converter according to a third embodiment of the present invention.
Figure 25:
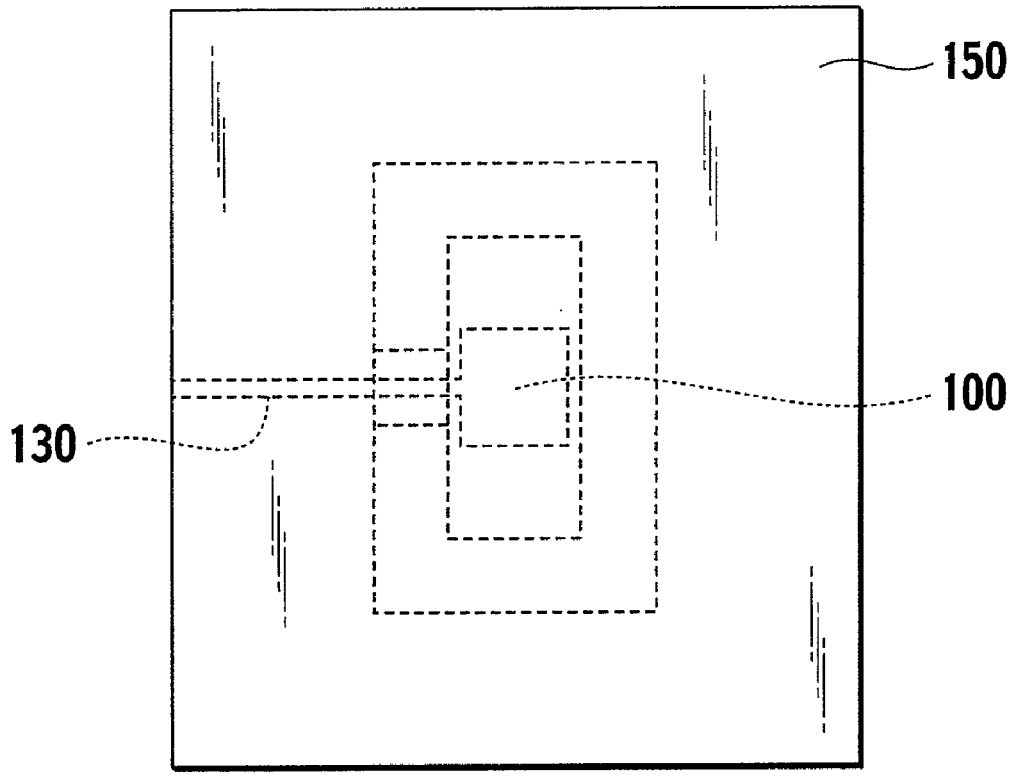
FIG. 25(*a*) is a top view of the example of the triple plate feeder-waveguide converter according to the third embodiment of the present invention.
Figure 25:
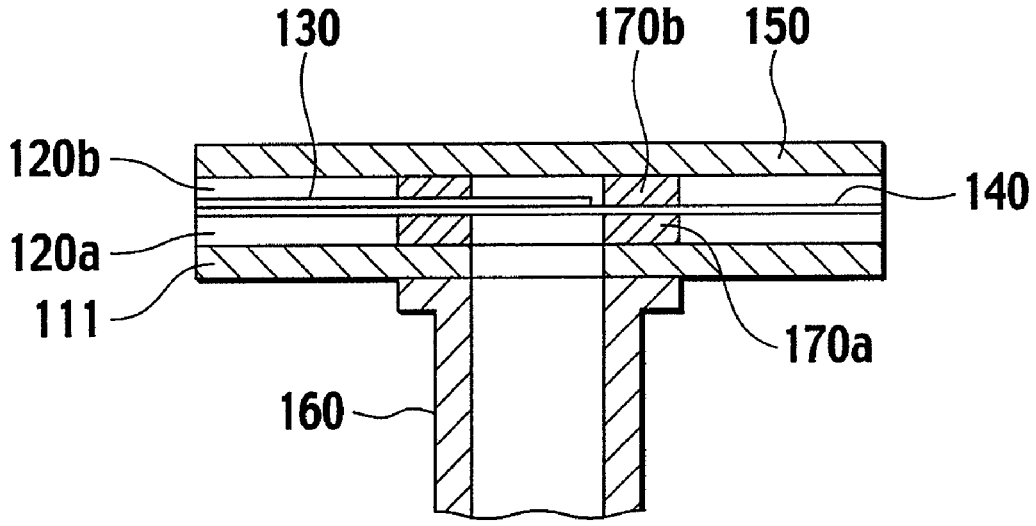

In a triple plate feeder-waveguide converter according to a third embodiment of the present invention, as illustrated in FIGS. 25(*a*) and 25(*b*), metal spacer portions 170*a*, 170*b* illustrated in FIG. 24(*b*) or the like can be formed by processed products made by punching a metal plate having a desired thickness. Here, the triple plate feeder-waveguide converter can easily be configured by stacking the metal spacer portion 170*a*, a film substrate 140, and the metal spacer portion 170*b* in this order as illustrated in FIG. 25(*b*) on a ground plate having a through hole with an inner dimension of a×b of the waveguide as illustrated in FIG. 24(*a*) and by arranging an upper ground plate 150 thereabove.

Figure 27:
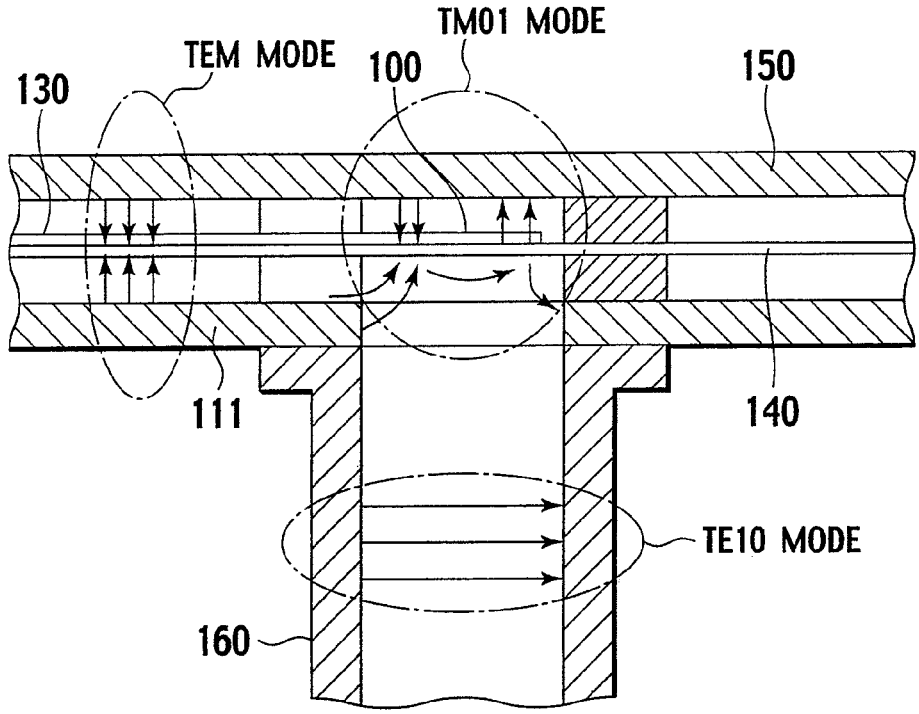
FIG. 27 is a cross-sectional view illustrating a conversion of resonance mode in the triple plate feeder-waveguide converter according to the third embodiment of the present invention.

With this configuration, there is excited TM01 mode resonance between the upper ground plate 150 and a square resonance patch pattern 100 formed on the surface of the film substrate 140, as illustrated in FIG. 27. Therefore, TEM mode resonance caused between a triple plate feeder formed by ground plates 111 {FIG. 24(*a*), 150} and a strip feeder conductor 130 {FIGS. 24(*c*), 25(*b*) and 27} formed on the surface of the film substrate 140 is converted into the TM01 mode resonance between the square resonance patch pattern 100 and the ground plate 150 and then into TE10 mode resonance by the square waveguide. As shown in FIG. 25(*b*), when assembling each member into the converter, it is needless to say that the center position of the square resonance patch pattern 100 preferably coincides with the center position of the inner portion of the waveguide 160 and each member is assembled together by using a guide pin or the like and firmly fixed by screws or the like in order to retain continuity of the inner wall between the through hole made in the ground plate 111 and the metal spacer portions 170*a*, 170*b*.

As shown in FIG. 24(*c*), it is preferable in the above configuration that a dimension L1 of the square resonance patch pattern 100 in the connection direction is set as about 0.27 times the free space wavelength $\lambda_0$ at a desired frequency and a dimension L2 of the square resonance patch pattern 100 in the direction perpendicular to the connection direction is set as about 0.38 times the free space wavelength $\lambda_0$ at the desired frequency. The reason why the L1 is set as about 0.27 times the free space wavelength $\lambda_0$ at a desired frequency is to realize a smooth conversion into a different electromagnetic mode by making it about 0.85 times the inner dimension a {FIG. 24(*c*)} of the waveguide. Preferably, the L1 is from 0.25 to 0.29 times the free space wavelength $\lambda_0$.

The reason why the L2 is set as about 0.38 times the free space wavelength $\lambda_0$ at the desired frequency is to make wider a range that can retain a return loss. Preferably, the L2 is from 0.32 to 0.4 times the free space wavelength $\lambda_0$.

The film substrate 140 is configured by etching off an unnecessary portion of a copper foil (metal foil) of a flexible substrate in which the copper foil has been attached on the face of a film as a base material so as to form the radiation elements 5 and feeders 6. In addition, the film substrate 140 can be configured using a copper-laminated plate in which a copper foil is attached on a thin resin plate obtained by impregnating a resin to a glass cloth.

The ground plate 111 and the upper ground plate 150 can be made of any metal plates or metal-plated plastic plates.

When they are made of specifically an aluminum plate, it is possible to make the converter according to this embodiment lightweight and less expensive. In addition, the ground plate 111 and the upper ground plate 150 can be configured using a flexible substrate in which a copper foil is attached on a film as a base material or a copper-laminated plate in which a copper foil is attached on a thin resin plate obtained by impregnating a resin to a glass cloth.

For the dielectrics 120*a*, 120*b* (see FIG. 25(*b*)), a foamed material having a low permittivity relative to air is preferably used. Polyolefin foamed materials such as polyethylene (PE) and polypropylene (PP), polystyrene foamed materials, polyurethane foamed materials, polysilicone foamed materials, and rubber foamed materials are cited as the foamed material. Among them, polyolefin foamed materials are more preferable because of a low permittivity relative to air.

Examples according to this embodiment are described in detail hereinafter.

Example 5

In this example (example 5), the ground plate 111 was made of an aluminum plate of 3 mm thick. The dielectrics 120*a*, 120*b* were made of a foamed polyethylene plate having a relative permittivity of about 1.1 and a thickness of 0.3 mm. The film substrate 4 was made of a film substrate in which a copper foil of 18 micrometers thick had been attached on a polyimide film of 25 micrometers thick. The ground plate 5 was made of an aluminum plate of 0.7 mm thick. The metal spacer portions 170*a*, 170*b* were made of an aluminum plate of 0.3 mm thick.

In the ground plate 111, a through hole having an inner dimension of a=1.27 mm and b=2.54 mm was formed by punching, the inner dimension being the same as that of the connection waveguide, as illustrated in FIG. 24(*a*). The dimension of the metal spacer portions 170*a*, 170*b* were a=1.27 mm, b=2.54 mm, c=1.5 mm, and d=1.3 mm, as illustrated in FIG. 24(*b*). The portions 170*a*, 170*b* were formed by punching.

In the film substrate 140, a square resonance patch pattern 100 having the dimension L1 in the feeder connection direction and the dimension L2 in the direction perpendicular to the feeder connection direction of about 0.27 times the free space wavelength $\lambda_0$ at a desired frequency, that is, L1=L2=1.07 mm, was formed at a position where the strip feeder conductor 300 having a width of 0.3 mm and the distal end of the waveguide 160 {FIG. 25(*b*)} were positioned, as illustrated in FIG. 24(*c*). In addition, in the configuration in FIGS. 25(*a*) and 25(*b*), each member was aligned and stacked by the aid of a guide-pin or the like passing through the members and fixed by screws passing from the upper surface of the ground plate 150 through the ground plate 111 in such a way {FIG. 25(*b*)} that the through hole of the ground plate 111 and the inner portion represented by a and b {FIG. 24(*b*)} of the metal spacer portions 170*a*, 170*b* coincided precisely in position with the square resonance patch pattern 100.

Figure 28:
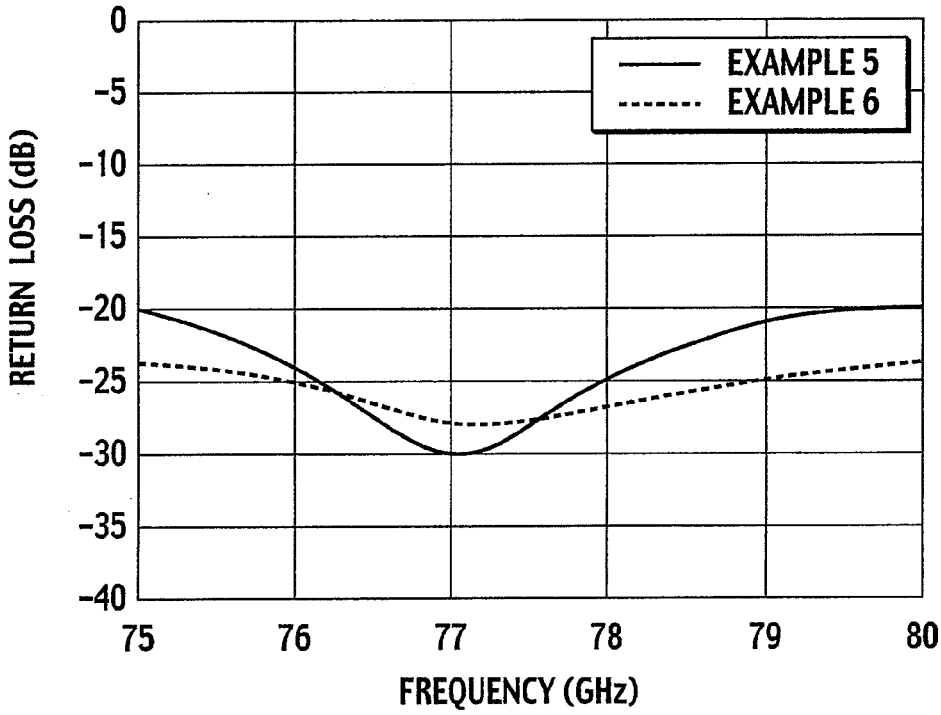
FIG. 28 is a graph illustrating a dependence of return loss on frequency comparing the example of the triple plate feeder-waveguide converter with the another example.

In the above configuration described with reference to FIGS. 25(*a*) and 25(*b*), an output portion and an input portion are symmetrically formed. When reflection characteristic was measured by connecting the terminated end of the waveguide to the output portion and connecting the waveguide to the input portion, the result was obtained as illustrated by a solid line in FIG. 28. As shown, a reflection loss in a 76.5 GHz band was −20 dB or lower, and a low reflection characteristic of −20 dB or lower was obtained in a wider frequency range.

Example 6

Figure 26:
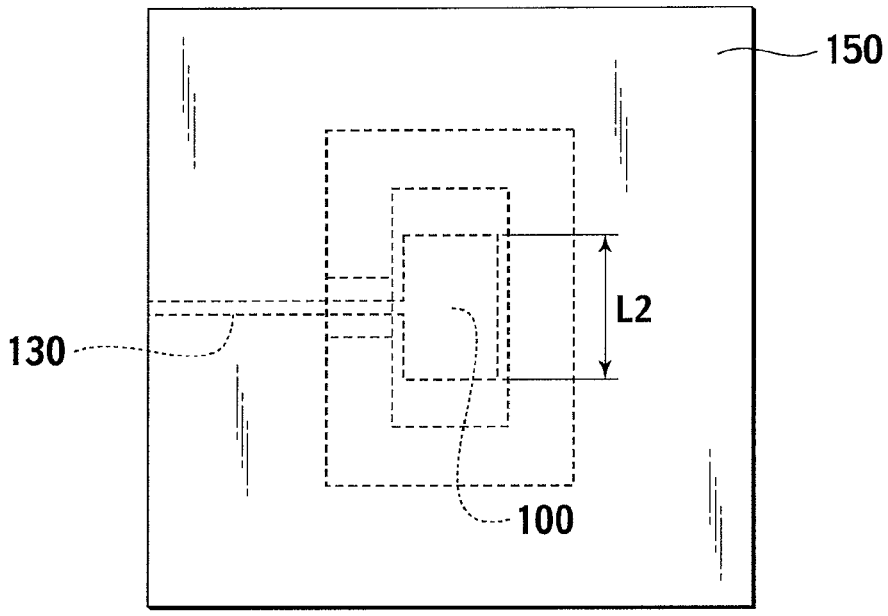
FIG. 26 is a top view of another example of a triple plate feeder-waveguide converter according to the third embodiment of the present invention.

Another example (example 6) according to this embodiment is illustrated in FIG. 26.

The example 6 (FIG. 26) has the same configuration as the example 5 {FIG. 25(*a*)} except that the dimension L2 in a direction perpendicular to the connection direction of the square resonance patch pattern 100 is 0.38 times the free space wavelength $\lambda_0$ at a desired frequency, that is, L2=1.5 mm.

In the above configuration illustrated in FIG. 26, the output portion and the input portion are symmetrically formed. When reflection characteristic was measured by connecting the terminated end of the waveguide to the output portion and connecting a waveguide to the input portion, the result was obtained as illustrated by a broken line in FIG. 28. As shown in EXAMPLES 5 and 6 of FIG. 28, a reflection loss in a 76.5 GHz band was −20 dB or lower, and a low reflection characteristic of −20 dB or lower was obtained in a wider frequency range.

Figure 23:
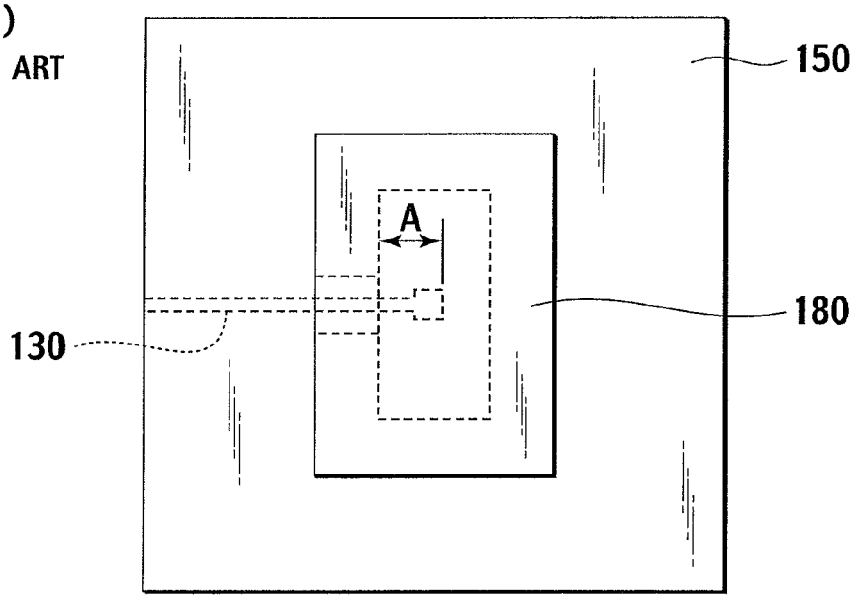
FIG. 23(*a*) is a top view of a prior art triple plate feeder-waveguide converter.
Figure 23:
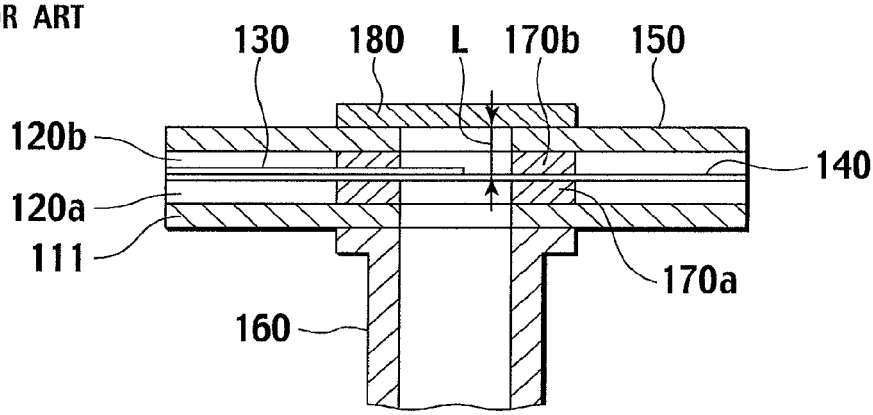
Figure 23:
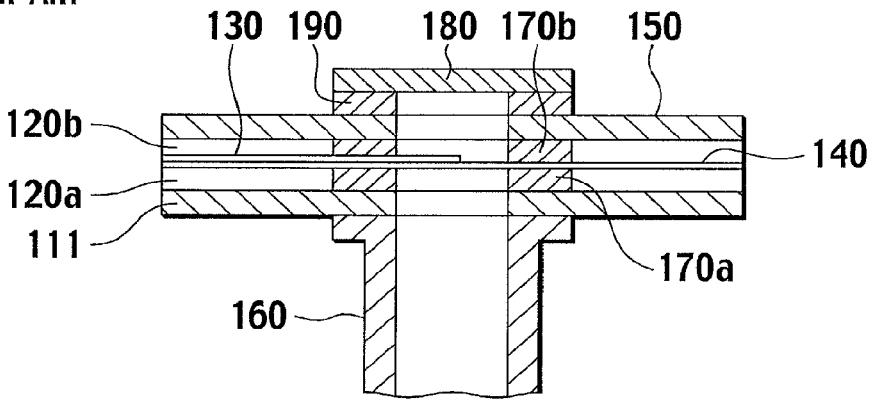

As described above, according to this embodiment, the metal spacer portions 170*a*, 170*b*, the upper ground plate 150 (see FIG. 26), the ground plate 111 and the like can be formed inexpensively by punching a metal plate and the like having a desired thickness. In FIG. 26, 130 is a strip feed conductor, as in prior configurations. Therefore, the short-circuit metal plate 180, as shown in FIGS. 23(*a*) to 23(*c*), and the short-circuit length adjustment metal plate 190, as shown in FIG. 24(*d*), that have been required in a conventional structure becomes unnecessary without impairing a low loss characteristic in a wide range, thereby realizing a triple plate feeder-waveguide converter that is easy to assemble, highly reliable in connection, and inexpensive.

By the way, as the film of the flexible substrate used to make the antenna substrate 40 in the first embodiment, the antenna circuit substrate 3 in the second embodiment, and the film substrate 140 in the third embodiment, polyethylene (PE), polypropylene (PP), polytetrafluoroethylene (PTFE), fluorinated ethylene propylene copolymer (FEP), ethylene tetra fluoro ethylene copolymer (ETFE), polyamide, polyimide, polyamide-imide, polyaryrate, thermoplastic polyimide, polyetherimide (PEI), polyetheretherketone (PEEK), polyethyleneterephthalate (PET), polybutyleneterephthalate (PBT), polystyrene, polysulphone, polyphenylene ether (PPE), polyphenylenesulfide (PPS), polymethylpentene (PMP) are cited. The film and the metal foil may be attached by adhesive. From a viewpoint of thermal resistance, dielectric properties, and versatility, the flexible substrate made by laminating the copper foil on the polyimide film is preferable. From a dielectric properties standpoint, fluorinated material films are preferably used.

INDUSTRIAL APPLICABILITY

According to the present invention, there is inexpensively provided a antenna device with an improved characteristic for use in a millimeter wave band.

The invention claimed is:

1. A triple plate feeder-waveguide converter comprising:

a triple plate feeder composed of a film substrate that has a strip feeder conductor and is arranged relative to the surface of a ground plate via a first dielectric having a thickness and an upper ground plate arranged over the surface of the film substrate via a second dielectric, and a waveguide having an inner dimension, said waveguide being connected to the ground plate;

wherein, there is provided in the ground plate a through hole in a connection position thereof in which the ground plate and the waveguide are connected with each other, the through hole having the same inner dimension as the waveguide, a first metal spacer portion having a dimension that is the same thickness as the first dielectric is provided in a support portion of the film substrate, the film substrate is interposed between the first metal spacer portion and a second metal spacer portion having a dimension that is the same dimension as the first metal spacer portion, the first and second metal spacer portions each has an inner dimension that is the same as the inner dimension of the waveguide, the upper ground plate is arranged on an upper end of the second metal spacer portion to close a waveguide portion formed by an inner wall of the first metal spacer portion and the second metal spacer portion and the through hole, and a square resonance patch pattern is provided at a tip portion of the strip feeder conductor disposed on the film substrate in such a way that the center position of the square resonance patch pattern coincides with the center position of the inner dimension of the waveguide.

2. A triple plate feeder-waveguide converter comprising:

a triple plate feeder composed of a film substrate that has a strip feeder conductor and is arranged relative to the surface of a ground plate via a first dielectric having a thickness and an upper ground plate arranged over the surface of the film substrate via a second dielectric, and a waveguide having an inner dimension, said waveguide being connected to the ground plate;

wherein, there is provided in the ground plate a through hole in a connection position thereof in which the ground plate and the waveguide are connected with each other, the through hole having the same inner dimension as the waveguide, a metal spacer portion having a dimension that is the same thickness as the first dielectric is provided in a support portion of the film substrate, the film substrate is interposed between the metal spacer portion and another metal spacer portion having a dimension that is the same dimension as the metal spacer portion, the upper ground plate is arranged on an upper end of the another metal spacer portion, a square resonance patch pattern is provided at a tip portion of the strip feeder conductor disposed on the film substrate in such a way that the center position of the square resonance patch pattern coincides with the center position of the inner dimension of the waveguide, a dimension L1 of the square resonance patch pattern in a feeder connection direction is about 0.27 times a free space wavelength $\lambda_0$ at a desired frequency, and a dimension L2 of the square resonance patch pattern in a direction perpendicular to the feeder connection direction is about 0.38 times the free space wavelength $\lambda_0$ at the desired frequency.

3. A triple plate feeder-waveguide converter comprising:

a triple plate feeder composed of a film substrate that has a strip feeder conductor and is arranged relative to the surface of a ground plate via a first dielectric having a thickness and an upper ground plate arranged over the surface of the film substrate via a second dielectric, wherein, there is provided in the ground plate a through hole in a connection position thereof in which the ground plate and a waveguide having an inner dimension are connected with each other, the through hole having the same inner dimension as the waveguide, a first metal spacer portion having a dimension that is the same thickness as the first dielectric is provided in a support portion of the film substrate, the film substrate is interposed between the first metal spacer portion and a second metal spacer portion having a dimension that is the same dimension as the first metal spacer portion, the first and second metal spacer portions each has an inner dimension that is the same as the inner dimension of the waveguide, the upper ground plate is arranged on an upper end of the second metal spacer portion to close a waveguide portion formed by an inner wall of the first metal spacer portion and the second metal spacer portion and the through hole, and a square resonance patch pattern is provided at a tip portion of the strip feeder conductor disposed on the film substrate in such a way that the center position of the square resonance patch pattern coincides with the center position of the inner dimension of the waveguide.

* * * * *